US009574465B2

(12) United States Patent
Takagi et al.

(10) Patent No.: US 9,574,465 B2
(45) Date of Patent: Feb. 21, 2017

(54) VALVE GEAR OF ENGINE

(71) Applicant: MAZDA MOTOR CORPORATION, Hiroshima (JP)

(72) Inventors: Akitomo Takagi, Hiroshima (JP); Toshimasa Kotani, Higashihiroshima (JP); Shunsuke Habara, Hiroshima (JP); Takashi Kashiwabara, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 113 days.

(21) Appl. No.: 14/460,290

(22) Filed: Aug. 14, 2014

(65) Prior Publication Data

US 2015/0075468 A1 Mar. 19, 2015

(30) Foreign Application Priority Data

Sep. 18, 2013 (JP) ..... 2013-193160

(51) Int. Cl.

| | |
|---|---|
| ***F01L 1/34*** | (2006.01) |
| ***F01L 1/344*** | (2006.01) |
| ***F01L 1/08*** | (2006.01) |
| ***F01L 13/00*** | (2006.01) |

(52) U.S. Cl.

CPC ..... *F01L 1/344* (2013.01); *F01L 1/08* (2013.01); *F01L 13/0036* (2013.01); *F01L 2013/0052* (2013.01); *F01L 2820/031* (2013.01)

(58) Field of Classification Search

CPC ..... F01L 2013/0052

See application file for complete search history.

(56) References Cited

U.S. PATENT DOCUMENTS

| | | | | |
|---|---|---|---|---|
| 7,404,383 | B2 * | 7/2008 | Elendt | F01L 13/0036 123/90.16 |
| 2007/0178731 | A1 * | 8/2007 | Elendt | F01L 13/0036 439/157 |
| 2011/0226205 | A1 * | 9/2011 | Kraus | F01L 1/047 123/90.18 |

FOREIGN PATENT DOCUMENTS

| | | | |
|---|---|---|---|
| DE | 102008029324 | A1 | 12/2009 |
| DE | 102010011897 | A1 | 9/2011 |
| JP | 2013-083202 | A | 5/2013 |

* cited by examiner

*Primary Examiner* — Zelalem Eshete

(74) *Attorney, Agent, or Firm* — Studebaker & Brackett PC

(57) ABSTRACT

A cam element portions is configured such that respective maximum lift portions (lift ending points) of both-side end-face cams thereof are provided at respective phases which are different from each other in a rotational direction and that a maximum value of a length, in an axial direction, between respective cam faces of the both-side end-face cams which are provided at the same phase is set to be a distance, in the axial direction, between a first operational member and a second operational member or smaller. Accordingly, in a valve gear of an engine in which cams operative to control opening/closing of a valve are switchable, it can be properly prevented that a camshaft locks and stop rotating because of an operational malfunction of an operational member or the like.

20 Claims, 10 Drawing Sheets

VALVE GEAR OF ENGINE

BACKGROUND OF THE INVENTION

The present invention relates to a valve gear of an engine for vehicles or the like, and particularly to a valve gear in which cams operative to control opening/closing of a valve are switchable.

A valve gear of an engine, in which plural cams having different-shaped nose portions are provided for each valve, and the valve-opening amount, the valve opening-closing timing, and the like are configured to be changeable according to an engine's operation state through a selection of a specified cam for opening/closing the valve from the plural cams, is known.

Japanese Patent Laid-Open Publication No. 2013-083202 and US Patent Application Publication No. 2011/0226205 A1, for example, disclose that a valve gear, in which a camshaft is comprised of a shaft portion and a cylindrical cam element portion which is coupled to the shaft portion with spline coupling so as to be moved in an axial direction of the shaft portion, the cam element portion has, at its outer periphery, plural cams for each valve which have different-shaped nose portions provided adjacently to each other, and a cam for opening/closing the valve is configured to be switchable through a move of the cam element portion in the axial direction.

Herein, in the valve gear disclosed in the above-described patent documents, a pair of end-face cams are provided symmetrically at both end faces of the cam element portion and there are further provided a pair of operational members, each of which is configured to project to a position facing the corresponding end-face cam and contact this end-face cam so as to move the cam element portion, in the axial direction, toward an arrangement side of the other operational member or retreat from the above-described position facing the corresponding end-face cam. The above-described operational members are driven (projected) by actuators, so that switching operation of the cams can be conducted.

Meanwhile, it has been recently desired for the engine equipped with the above-described valve gear that the switching to the best cam is conducted in every combustion cycle in accordance with the engine's driving state, that is—that the cam switching is conducted continuously in a moment. While it is necessary to drive the actuator so that the operational member can project or retreat at a desired timing in order to fulfill the above-described desire, it may be difficult that no malfunction happens to the operational member. Herein, the end-face cams provided at the both sides of the cam element portion are provided symmetrically such that respective maximum-lift portions thereof are positioned at the same phase in the valve gear disclosed in the former of the above-described patent documents. Therefore, when the cam portion is switched by making one of the operational members project, thereby moving the cam element portion toward the arrangement side of the other operational member, if the other operational member projects erroneously because of the operational malfunction or the like, there is a phase in which the length between the end-face cams provided at the both sides of the cam element portion is greater than an arrangement distance between the pair of operational members. As shown in FIG. 12, at a specified phase in which the length between both-side end-face cams 123, 123 is greater than the arrangement distance Lpin between two operational members 132, 132, a cam element portion 120 gets stuck between the both-side operational members 132, 132, so that there is a concern that a camshaft 102 may lock and stop rotating.

SUMMARY OF THE INVENTION

The present invention has been devised to solve the above-described problem, and an object of the present invention is to provide a valve gear of an engine which can properly prevent that the camshaft locks and stops rotating because of the operational malfunction or the like of the operational member.

According to the present invention, there is provided a valve gear of an engine, comprising a camshaft having a shaft portion and a cam element portion, the cam element portion being coupled to the shaft portion so as to rotate integrally with the shaft portion and to move in an axial direction of the shaft portion, and an operational device operative to move the cam element portion of the camshaft in the axial direction relative to the shaft portion, wherein the cam element portion comprises two cam portions for each valve which have a common base circle and different-shaped nose portions, which are provided adjacently to each other in the axial direction, the two cam portions operative to control opening/closing of the valve being configured to be switchable when moved in the axial direction on the shaft portion, the cam element portion further comprises a pair of end-face cams which are provided at both-end faces, in the axial direction, of the cam element portion, each of the end-face cams having a lift portion which is configured to project in the axial direction such that the amount of projection of the lift portion increases gradually along a rotational direction of the cam element portion in a specified phase range, the operational device comprises a first operational member which is arranged on one side of the cam element portion and a second operational member which is arranged on the other side of the cam element portion, the first operational member being configured to be driven by an actuator so as to take an operative position in which the first operational member projects to a position facing one of the end-face cams which is located on an arrangement side of the first operational member and contacts the lift portion of the above-described one of the end-face cams so as to move the cam element portion along the shaft portion toward the other side of the cam element portion and a retreat position in which the first operational member retreats from the position facing the one of the end-face cams, the second operational member being configured to be driven by an actuator so as to take an operative position in which the second operational member projects to a position facing the other of the end-face cams which is located on an arrangement side of the second operational member and contacts the lift portion of the other of the end-face cams so as to move the cam element portion along the shaft portion toward the one side of the cam element portion and a retreat position in which the second operational member retreats from the position facing the other of the end-face cams, and the cam element portion is configured such that respective maximum lift portions of the pair of end-face cams are provided at respective phases which are different from each other in the rotational direction and that the maximum value of a length, in the axial direction, between respective cam faces of the pair of end-face cams which are provided at the same phase is set to be an arrangement distance, in the axial direction, between the first operational member and the second operational member or smaller.

Herein, the above-described "cam portion" includes the one in which the shape of the nose portion matches the shape of the base circle (i.e., includes a portion, the lift amount of which is zero).

According to the present invention, since the cam element portion is configured such that the respective maximum lift portions of the pair of end-face cams are provided at the respective phases which are different from each other in the rotational direction and that the maximum value of the length, in the axial direction, between the respective cam faces of the pair of end-face cams which are provided at the same phase is set to be the arrangement distance, in the axial direction, between the first and second operational members or smaller, that is—since there is not a phase in which the length between the pair of end-face cams provided at the both sides of the cam element portion is greater than the arrangement distance between the first and second operational members, the cam element portion does not get stuck between the first and second operational members. Thereby, the present invention can properly prevent that the camshaft locks and stops rotating.

According to an embodiment of the present invention, the respective lift portions of the pair of end-face cams of the cam element portion are configured such that the above-described specified phase ranges thereof overlap each other in the rotational direction. Thereby, a non-lift portion (i.e., a portion where no lift is formed) of at least one of the pair of end-face cams is configured such that a phase range thereof is relatively wide, compared with a case in which the respective lift portions of the pair of end-face cams of the cam element portion are configured such that the above-described specified phase ranges therefore do not overlap each other in the rotational direction. Herein, the operational members are configured to project within the phase range of the non-lift portion of the above-described at least one of the pair of end-face cams. Therefore, if this phase range was narrow, it might be necessary to provide any particular means for obtaining a high driving-speed of the actuator in order to increase the projecting speed of the operational member properly. According to the above-described embodiment, the properly wide phase range for the projection of the operational member can be ensured, preventing the locking of the cam shaft, so that the above-described particular means may be unnecessary.

According to another embodiment of the present invention, the engine is equipped with plural cylinders which are arranged in the axial direction of the shaft portion of the camshaft, the cam element portion is configured as plural cam element portions which are provided for the engine as a whole and at least one of which is provided for each cylinder, at least part of the plural cam element portions includes a pair of cam element portions which are provided for valves of two adjacent cylinders, the pair of cam element portions being configured such that respective lift portions of the end-face cams thereof which face each other are provided at different phases, in the rotational direction, from each other and come to overlap each other in the axial direction at least partially when the pair of cam element portions come close to each other, and the operational device further includes a common operational member of a common operational device, which is configured, in a state in which the pair of cam element portions are in a close state, to project to a position facing the both end-face cams of the pair of cam element portions and contact the both lift portions of the end-face cams so as to move the pair of cam element portions away from each other when being at the operative position thereof. According to this embodiment, since the common operational member taking the operative position which makes the pair of cam element portions move away from each other is provided and also the pair of cam element portions are configured such that respective lift portions of the end-face cams thereof which face each other are provided at different phases, in the rotational direction, from each other and also come to overlap each other in the axial direction at least partially when the pair of cam element portions come close to each other, the valve gear can be made properly compact in the axial direction of the camshaft, so that the engine compactness can be improved.

Herein, it may be preferable that the above-described common operational member is configured substantially in a cylindrical shape, and the pair of cam element portions are configured such that in the state in which the pair of cam element portions are in the close state, the minimum value of a distance, in the axial direction, between respective cam faces of the facing end-face cams thereof which are provided at the same phase is smaller than the diameter of the common operational member. Thereby, when the pair of cam element portions are in the close state, even if the common operational member projects because of some operational trouble or the like, this common operational member merely hits on a surface of an outer peripheral portion of the above-described respective cam faces of the end-face cams, not contacts the cam faces of the end-face cams. Accordingly, it can be prevented that the cam element portions move unexpectedly and improperly.

Further, it may be preferable that the pair of cam element portions further comprise, respectively, a slope portion which slants outward toward the rotary-delay side from the maximum-lift portion of the end-face cam which the common operational member contacts, the slope portion being configured to retreat the common operational member to the retreat position from the operative position when sliding on the common operational member after the axial-direction move of the cam element portions caused by the end-face cams is finished. Thereby, the common operational member being at the operative position can be moved to the retreat position surely by the slope portion. Further, since the slope portion is configured to operate (work) after the cam element portion has been moved by the common operational member, the common operational member can be quickly retreated to the retreat position, ensuring the move of the cam element portion. Thereby, even in a case in which the cams are switched continuously, the switching operation of the cam portions can be conducted continuously in a moment.

Other features, aspects, and advantages of the present invention will become apparent from the following description which refers to the accompanying drawings.

DETAILED DESCRIPTION OF THE INVENTION

Hereinafter, a preferred embodiment of the present invention will be described referring to an example in which a valve gear according to the present invention is applied to a four-cylinder four-valve DOHC engine.

(Schematic Structure of Valve Gear)

Figure 1:
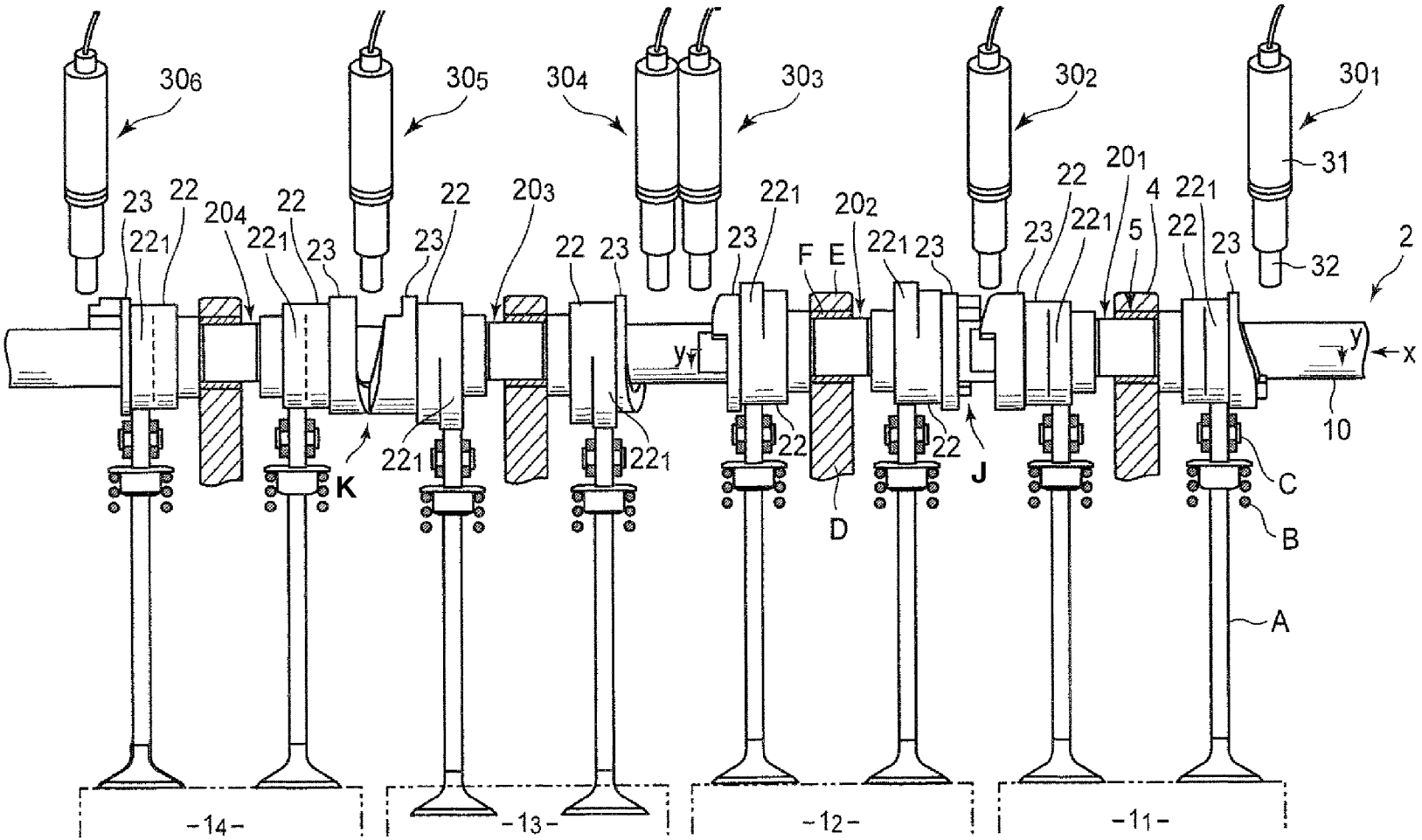
FIG. 1 is a side view showing a schematic structure of an exhaust-side valve gear according to an embodiment of the present invention.

FIG. 1 shows a structure of an exhaust-side valve gear according to the present embodiment. This valve gear comprises, in total, eight exhaust valves A . . . A, two of which are provided at each of first-fourth cylinders $\mathbf{1}_1$-$\mathbf{1}_4$, and return springs B . . . B operative to impel the exhaust valves A . . . A in a closing direction, which are provided at a cylinder head, not illustrated. Further, a camshaft 2 operative to open the exhaust valves A . . . A against an impelling force of the return springs B . . . B via rocker arms C . . . C is provided at an upper portion of the cylinder head.

The camshaft 2 is rotatably supported at journal portions F . . . F which are comprised of vertical wall portions D . . . D located at central positions of the respective cylinders $\mathbf{1}_1$-$\mathbf{1}_4$ of the cylinder head and cap members E . . . E attached to upper portions of the vertical wall portions D . . . D. This camshaft 2 is configured to be rotationally driven by a crank shaft, not illustrated, via a chain.

Further, the camshaft 2 is comprised of a shaft portion 10 and first-fourth cam element portions $\mathbf{20}_1$-$\mathbf{20}_4$ which are coupled to the shaft portion 10 with spline coupling so as to rotate integrally with the shaft portion 10 and move in an axial direction of the shaft portion 10. The cam element portions $\mathbf{20}_1$-$\mathbf{20}_4$ are arranged in line on the shaft portion 10 at specified positions which correspond to the respective cylinders $\mathbf{1}_1$-$\mathbf{1}_4$, respectively.

There are provided six electromagnetic operational devices $\mathbf{30}_1$-$\mathbf{30}_6$ operative to move the respective cam element portions $\mathbf{20}_1$-$\mathbf{20}_4$ on the shat portion 10. Specifically, the first operational device $\mathbf{30}_1$ is arranged at a front-end position of the engine where the first cylinder $\mathbf{1}_1$ is positioned, the second operational device $\mathbf{30}_2$ is arranged at a middle position between the first cylinder $\mathbf{1}_1$ and the second cylinder $\mathbf{1}_2$, the third operational device $\mathbf{30}_3$ is arranged at a front-side position between the second cylinder $\mathbf{1}_2$ and the third cylinder $\mathbf{1}_3$, the fourth operational device $\mathbf{30}_4$ is arranged at a rear-side position between the second cylinder $\mathbf{1}_2$ and the third cylinder $\mathbf{1}_3$, the fifth operational device $\mathbf{30}_3$ is arranged at a middle position between the third cylinder $\mathbf{1}_3$ and the fourth cylinder $\mathbf{1}_4$, and the sixth operational device $\mathbf{30}_6$ is arranged at a rear-end position of the engine.

Figure 2:
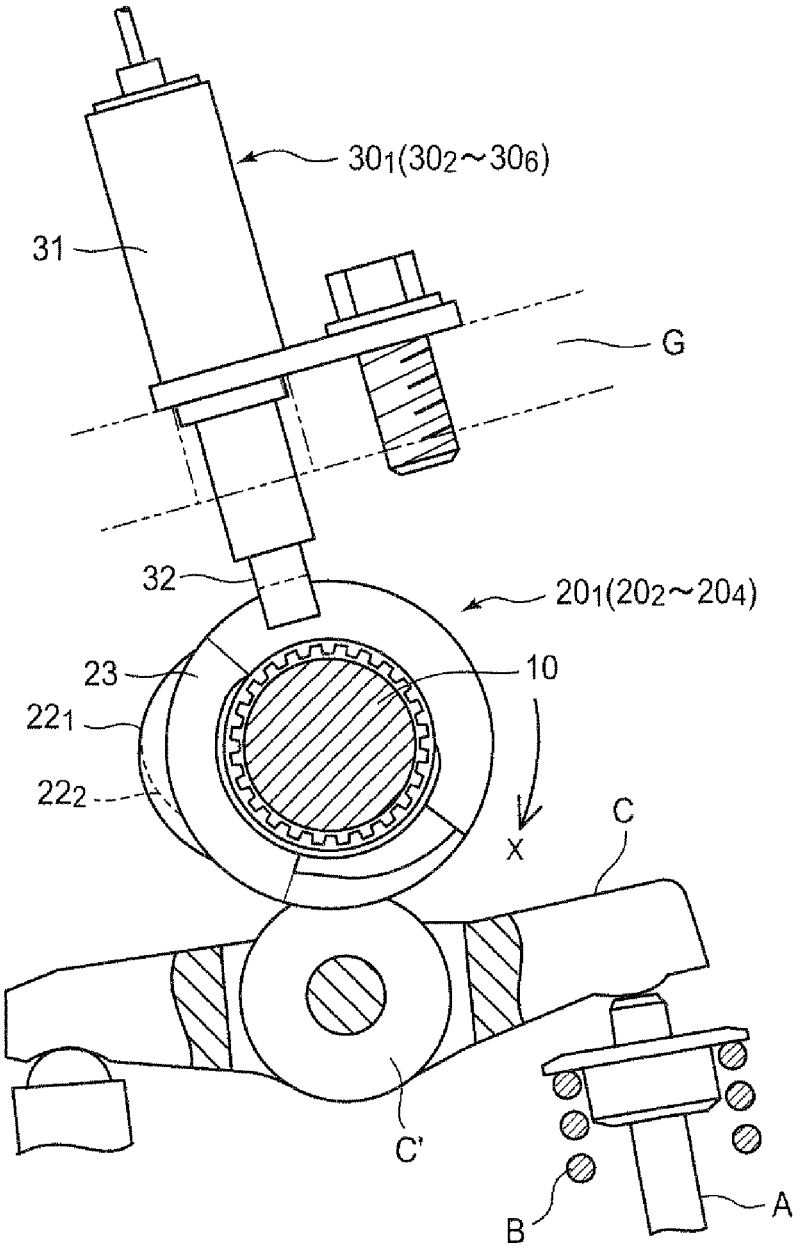
FIG. 2 is an elevational view of the valve gear, when viewed in an x direction of FIG. 1.

As shown in FIG. 2, the above-described operational devices $\mathbf{30}_1$-$\mathbf{30}_6$ are arranged on one side of the camshaft 2 which is opposite to a cam follower C' of the rocker arm C such that pin portions 32 thereof are directed to the axial center of the camshaft 2. In the present embodiment, the operational devices $\mathbf{30}_1$-$\mathbf{30}_6$ are attached to a cylinder head cover G which covers over the camshaft 2 and the cam element portions $\mathbf{20}_1$-$\mathbf{20}_4$.

Each of the operational devices $\mathbf{30}_1$-$\mathbf{30}_6$ comprises a body 31 which includes an electromagnetic actuator therein, the substantially cylindrical-shaped pin portion 32 which can project from the body 31 when the electromagnetic actuator is activated, and a return spring (not illustrated) which impels the pin portion 32 toward the body 31. When the electromagnetic actuator is not activated, the pin portion 32 is held at its retreat position where the pin portion 32 retreats upward by means of an impelling fore of the return spring as shown by a broken line in FIG. 2. Meanwhile, when the electromagnetic actuator is activated, the pin portion 32 moves to its operative position where the pin portion 32 projects downward against the impelling fore of the return spring as shown by a solid line in FIG. 2.

A control of the operational devices $\mathbf{30}_1$-$\mathbf{30}_6$ with the above-described activation of the electromagnetic actuator is conducted by a computer, not illustrated, based on a detection signal from an engine rotational-angle sensor, not illustrated.

Figure 3:
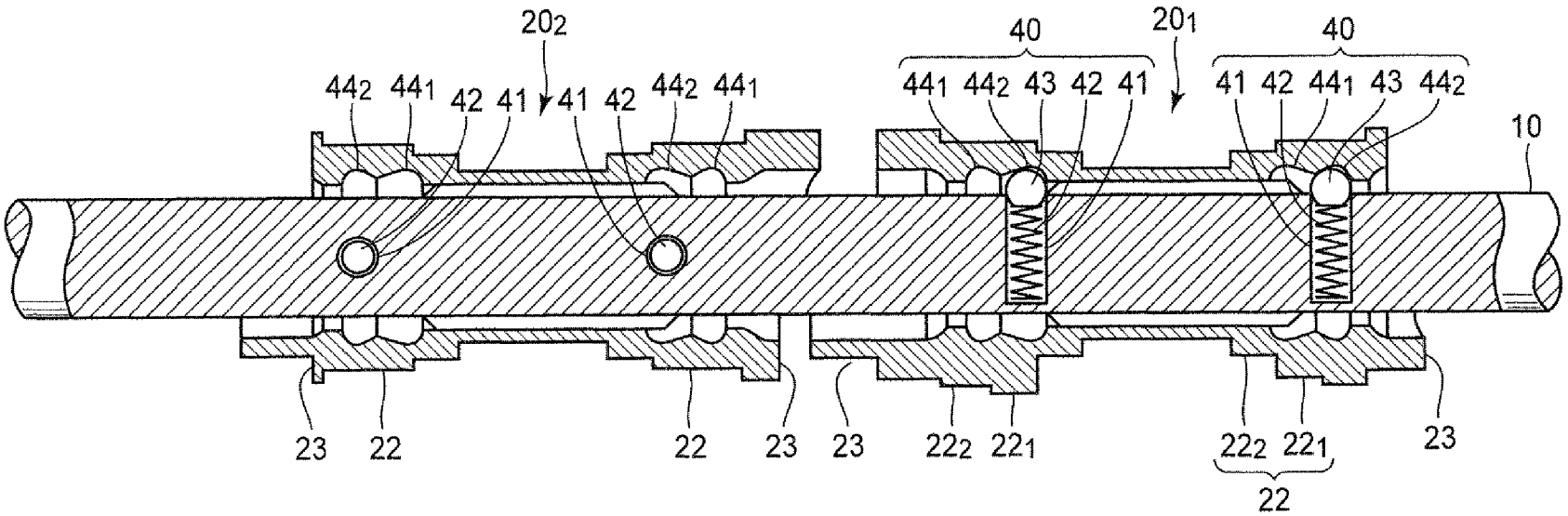
FIG. 3 is an enlarged sectional view taken along line y-y of FIG. 1.

Further, as shown in FIG. 3 showing an example of the first and second cam element portions $\mathbf{20}_1$, $\mathbf{20}_2$, a detent mechanism 40 is provided at each connection portion where the cam element portions $\mathbf{20}_1$-$\mathbf{20}_4$ and the shaft portion 10 are connected to each other for positioning of the axial-direction move of the cam element portions $\mathbf{20}_1$-$\mathbf{20}_4$ at specified two positions by means of the operational devices $\mathbf{30}_1$-$\mathbf{30}_6$.

The detent mechanism 40 comprises a hole 41 which is opened at the shaft portion 10 in a radial direction, a spring 42 which is stored in the hole 41, a detent ball 43 which is provided at an opening portion of the hole 41 so as to be impelled from an outer peripheral face of the shaft portion 10 toward the radial outside by the spring 42, and two peripheral grooves $\mathbf{44}_1$, $\mathbf{44}_2$ which are formed side by side in the axial direction at an inner peripheral face of each of the cam element portions $\mathbf{20}_1$-$\mathbf{20}_4$. This detent mechanism 40 is configured such that each of the cam element portions $\mathbf{20}_1$-$\mathbf{20}_4$ is positioned at a first position shown in FIG. 1 when the detent ball 43 engages with one of the peripheral grooves $\mathbf{44}_1$, whereas each of the cam element portions $\mathbf{20}_1$-$\mathbf{20}_4$ is positioned at a second position shown in FIG. 4 when the detent ball 43 engages with the other peripheral groove $\mathbf{44}_2$.

Herein, when the cam element portions $\mathbf{20}_1$-$\mathbf{20}_4$ are all positioned at the first position as shown in FIG. 1, the first cam element portions $\mathbf{20}_1$ is positioned rearward, the second cam element portions $\mathbf{20}_2$ is positioned forward, the third cam element portions $\mathbf{20}_3$ is positioned rearward, and the fourth cam element portions $\mathbf{20}_4$ is positioned forward. Accordingly, respective facing end faces of the first and second cam element portions $\mathbf{20}_1$, $\mathbf{20}_2$ are close to each other, respective facing end faces of the second and third cam element portions $\mathbf{20}_2$, $\mathbf{20}_3$ are away from each other, and respective facing end faces of the third and fourth cam element portions $\mathbf{20}_3$, $\mathbf{20}_4$ are close to each other.

Figure 4:
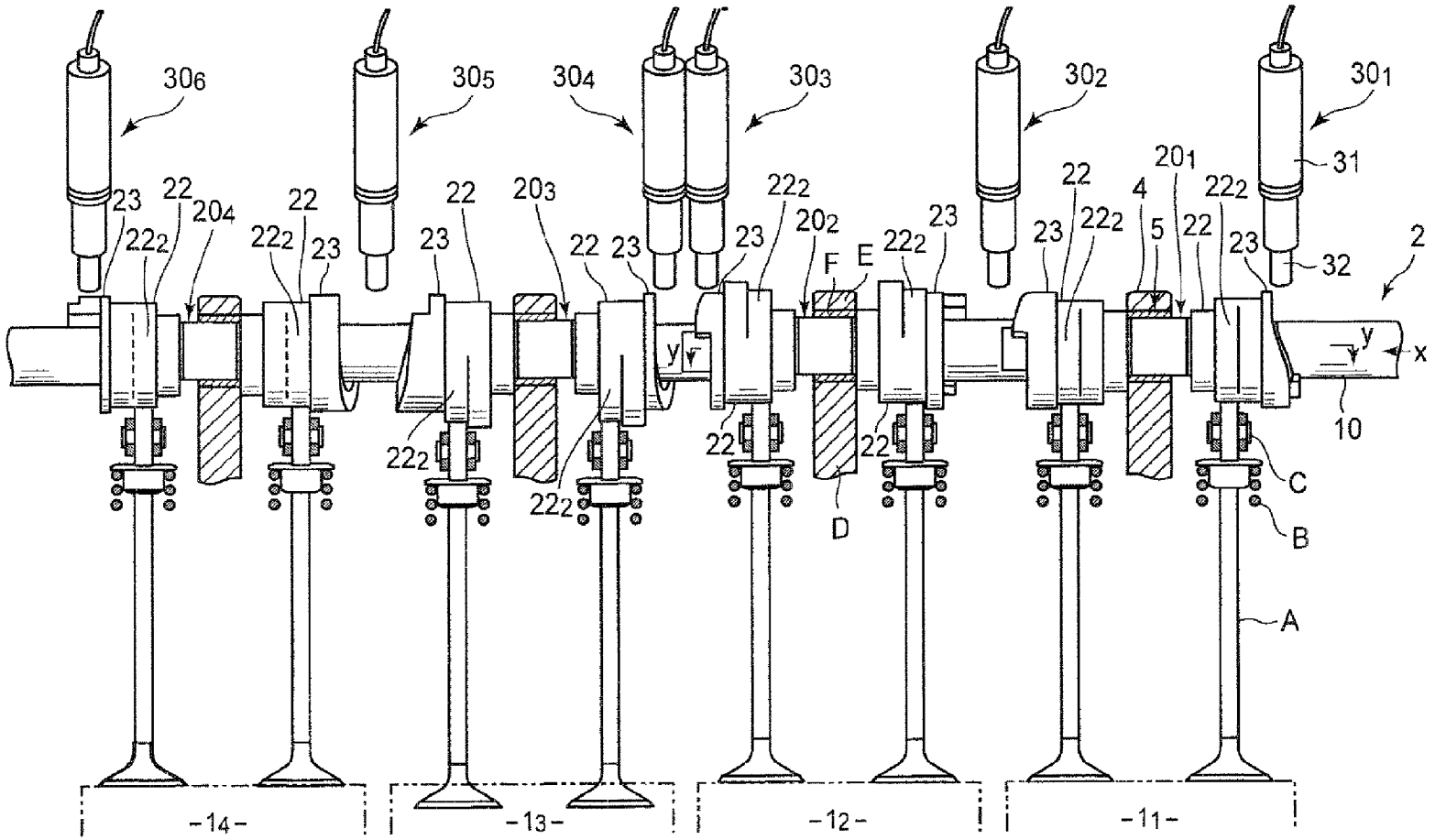
FIG. 4 is a side view showing a state in which cam portions operative to control opening/closing of valves have been switched from the state of FIG. 1.

Further, when the cam element portions $\mathbf{20}_1$-$\mathbf{20}_4$ are all positioned at the second position as shown in FIG. 4, the first cam element portions $\mathbf{20}_1$ is positioned forward, the second cam element portions $20_2$ is positioned rearward, the third cam element portions $20_3$ is positioned forward, and the fourth cam element portions $20_4$ is positioned rearward. Accordingly, the respective facing end faces of the first and second cam element portions $20_1$, $20_2$ are away from each other, the respective facing end faces of the second and third cam element portions $20_2$, $20_3$ are close to each other, and the respective facing end faces of the third and fourth cam element portions $20_3$, $20_4$ are away from each other.

(Cam Element Portion)

Next, the first cam element portion $20_1$ and the second cam element portion $20_2$ will be described more specifically referring to FIGS. 5-9 as an example of the cam element portions $20_1$-$20_4$.

Figure 5:
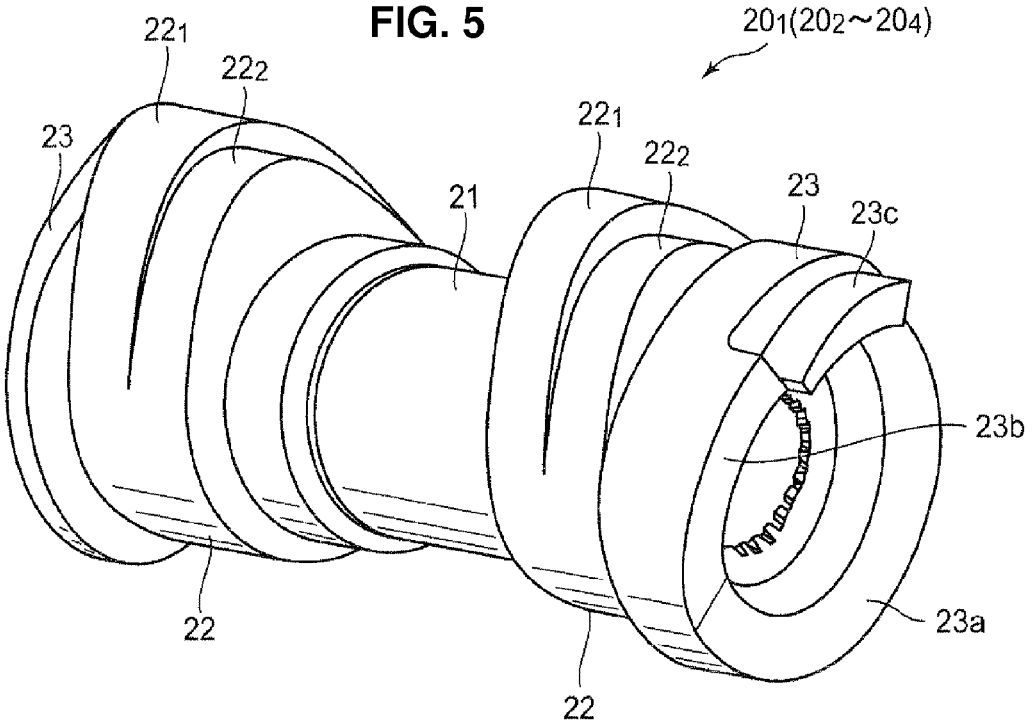
FIG. 5 is a perspective view of a cam element portion.

The cam element portion $20_1$ ($20_2$-$20_4$) is formed in a cylindrical shape, and the outer peripheral face of its middle portion is constituted as a journal portion 21 which is supported at the above-described journal portion F. A pair of operative portions 22, 22 for the two exhaust valves A, A of the first cylinder are formed at both-side ends of the cam element portion $20_1$. At each of the operative portions 22, 22 are provided, as shown in FIG. 5, a first cam portion $22_1$ which has a large lift amount for the low engine speed, for example, and a second cam portion $22_2$ which has a small lift amount for the high engine speed, for example, which are arranged side by side in the axial direction.

Figure 7A:
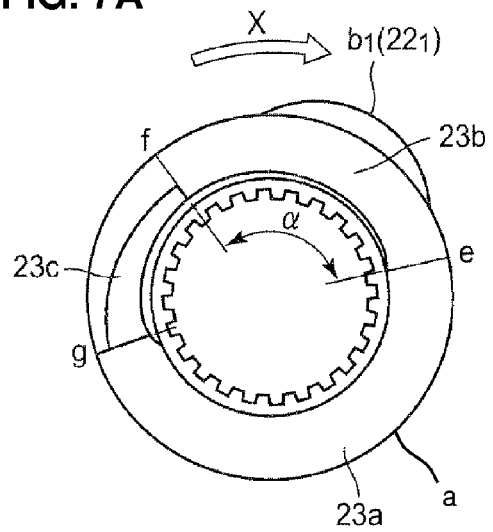
FIGS. 7A, 7B are elevational views of the cam element portion of the first cylinder.
Figure 7B:
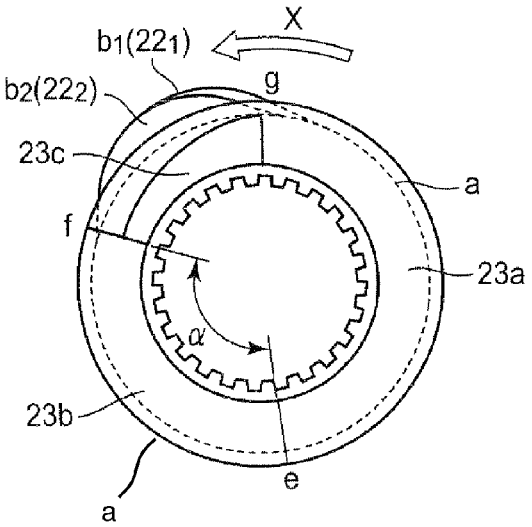

The first cam portion $22_1$ and the second cam portion $22_2$ are configured, as shown in FIG. 7B, such that their base circles a are common thereto and also their nose portions $b_1$, $b_2$ having the different lift amount from each other are provided on the base circles a with a slight difference in phase between them. And the first cam portion $22_1$ and the second cam portion $22_2$ are provided at the two operative portions 22, 22, respectively, such that their arrangement orders in the axial direction and the phases of their nose portions $b_1$, $b_2$ match each other. Herein, the above-described base circles a being common thereto means that the base circular diameter of the base circle a of the first cam portion $22_1$ is equal to the base circular diameter of the base circle a of the second cam portion $22_2$.

In this case, as shown in FIGS. 1 and 4, in the first cam element portion $20_1$ and the third cam element portion $20_3$, the respective first cam portions $22_1$ are arranged forward and the respective second cam portions $22_2$ are arranged rearward. Meanwhile, in the second cam element portion $20_2$ and the fourth cam element portion $20_4$, the respective second cam portions $22_2$ are arranged forward and the respective first cam portions $22_1$ are arranged rearward.

Further, it is configured such that when the positioning of the cam element portions $20_1$-$20_4$ by means of the detent mechanism 40 is conducted at the first position on the shaft portion 10, the respective first cam portions $22_1$, $22_1$ are located so as to correspond to the cam followers C', C' of the rocker arms C, C of the corresponding cylinders $1_1$-$1_4$ (see FIG. 1), and when the positioning of the cam element portions $20_1$-$20_4$ is conducted at the second position on the shaft portion 10, the respective second cam portions $22_2$, $22_2$ are located so as to correspond to the above-described cam followers C', C' (see FIG. 4).

Herein, the engine of the present embodiment is configured such that the order of combustion of the cylinders is set as the third cylinder $1_3$→the fourth cylinder $1_4$→the second cylinder $1_2$→the first cylinder $1_1$. Moreover, the first-fourth cam element portions $20_1$-$20_4$ are coupled, with the spline coupling, to the shaft portion 10 with the difference in phase such that the nose portions $b_1$, $b_2$ of the first cam portion $22_1$ or the second cam portion $22_2$ of the cam element portions $20_1$-$20_4$ are located so as to correspond to the cam followers C', C' in this order at each time of a 90° rotation of the camshaft 2.

Also, each of the cam element portions $20_1$-$20_4$ comprises a pair of end-face cams 23, 23 at its front-and-rear both ends.

Figure 6:
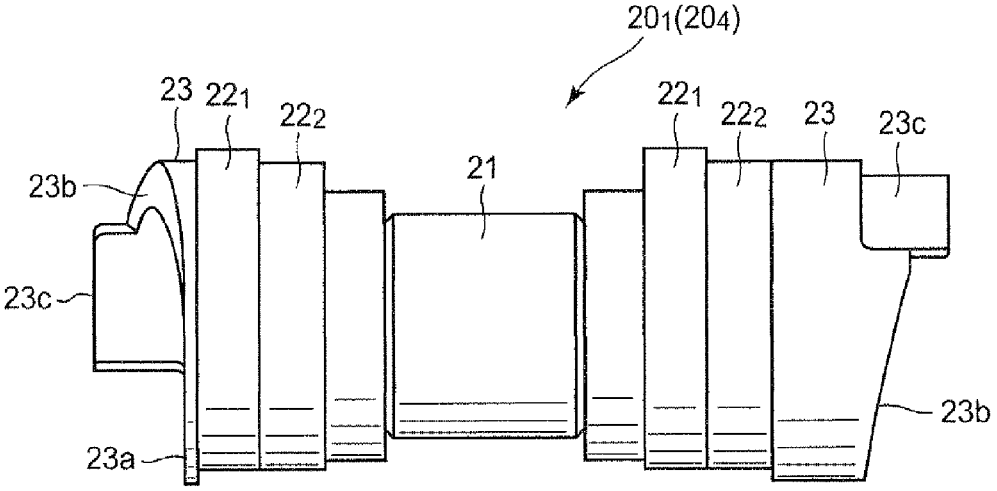
FIG. 6 is a side view of the cam element portion of a first cylinder.
Figure 8:
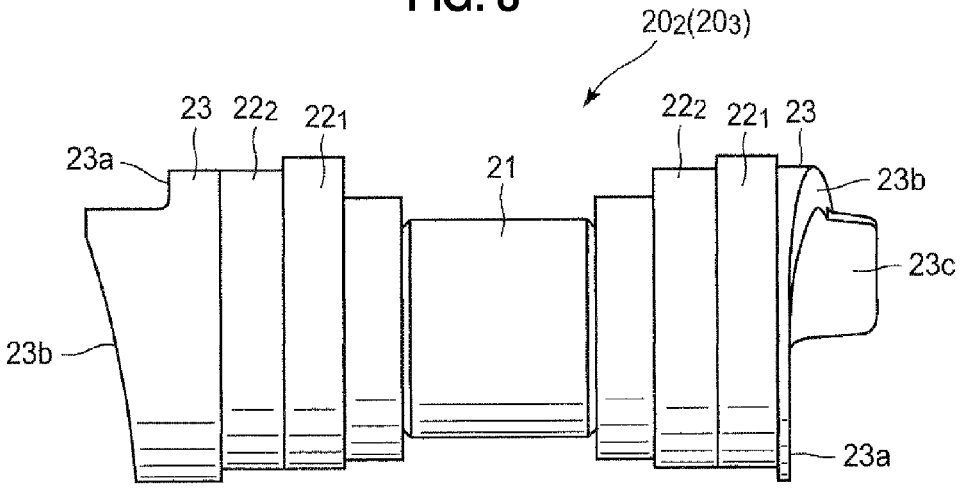
FIG. 8 is a side view of the cam element portion of a second cylinder.
Figure 9A:
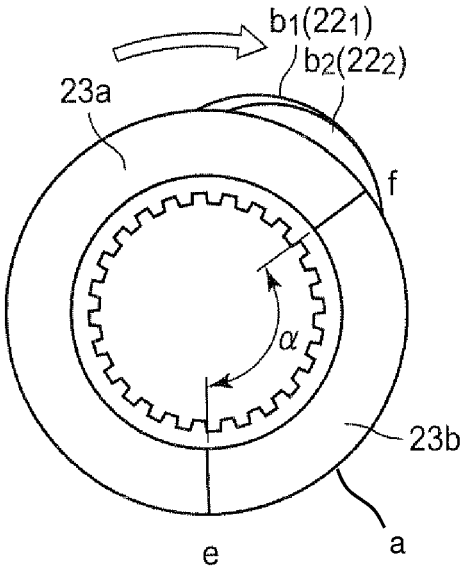
FIGS. 9A, 9B are elevational views of the cam element portion of the second cylinder.
Figure 9B:
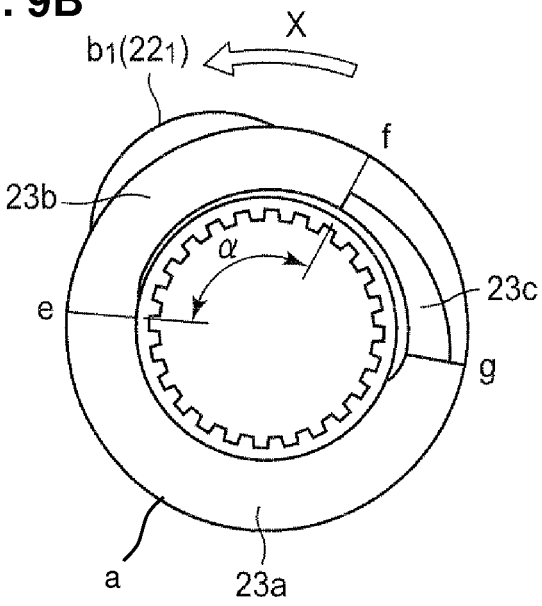

As shown in FIGS. 6 and 8, the end-face cams 23, 23 at the front-and-rear both ends have a pair of lift portions 23*b*, 23*b* which project in the axial direction, forward and rearward, from respective standard faces 23*a*, 23*a* which correspond to the cross section of the cam element portion $20_1$ ($20_2$-$20_4$). This lift portion 23*b* is configured, as shown in FIGS. 7A, B and 9A, B, such that the lift amount (projection amount) thereof from the standard face 23*a* (having the lift amount being zero) increases gradually along a rotational direction X in a specified phase range a (about 120°, for example) from a lift starting point e to a lift ending point f (corresponding to a "maximum-lift portion" in claim 1), and returns to the standard face 23*a* at the lift ending point f or a slope ending point g, which will be described later.

Herein, additionally to the above-described constitution which is a premise, the cam element portions $20_1$-$20_4$ are configured such that the lift ending points f of the end-face cams 23, 23 provided at the both sides thereof are provided at respective phases which are different from each other in the rotational direction, as apparent from comparing FIGS. 7A and 7B (FIGS. 9A and 9B), which is a charactering feature of the present invention.

Moreover, the cam element portions $20_1$-$20_4$ are configured such that a maximum value Lmax of a length, in the axial direction, between respective cam faces of the end-face cams 23, 23 which are provided at the same phase is set to be an arrangement distance Lpin, in the axial direction, between the pin portions 32, 32 or smaller.

Additionally, in the present embodiment, the respective lift portions 23*b*, 23*b* of the end-face cams 23, 23 provided at the both end portions of the cam element portions $20_1$-$20_4$ are configured such that the respective phase ranges $\alpha$ from the lift starting points e to the lift ending points f overlap each other at least at respective phase ranges $\beta$ which are part thereof (shown in FIGS. 10 and 11), as apparent from comparing FIGS. 7A and 7B (FIGS. 9A and 9B), Further, according to the cam element portions $20_1$-$20_4$ spline-coupled to the shaft portion 10 with the specified differences in phase, respectively, in accordance with the order of combustion of the cylinders $1_1$-$1_4$ as described above, the facing end-face cams 23, 23 of the cam element portions $20_1$-$20_4$ also face each other with differences in phase, respectively. In the present embodiment, as shown by reference characters J, K in FIG. 1, the pair of first and second cam element portions $20_1$, $20_2$ and the pair of third and fourth cam element portions $20_3$, $20_4$, which are provided adjacently, respectively, are configured such that the lift portions 23*b*, 23*b* of the facing end-face cams 23, 23 are provided at different phases and come to overlap each other in the axial direction at least partially when the pairs of cam element portions $20_1$, $20_2$ and $20_3$, $20_4$ come close to each other, respectively. At this time, the minimum value of a distance, in the axial direction, between the respective cam faces of the above-described facing end-face cams 23, 23 which are provided at the same phase is set to be smaller than the diameter of the pin portion 32.

The pin portions 32, 32 of the above-described second and fifth operational devices $30_2$, $30_3$ are configured such that these pin portions 32, 32 project to their operative positions which are located at a position facing the facing faces of the respective end-face cams 23, 23 which face each other when the pair of cam element portions $20_1$, $20_2$ and $20_3$, $20_4$ come close to each other, and contact the end-face cams 23, 23 so as to slide the pairs of cam element portions $\mathbf{20}_1$, $\mathbf{20}_2$ and $\mathbf{20}_3$, $\mathbf{20}_4$ which have come close to each other in a specified direction where they move away from each other in accordance with the rotation of the camshaft 2.

At this time, the first and second cam element portions $\mathbf{20}_1$, $\mathbf{20}_2$ and the third and fourth cam element portions $\mathbf{20}_3$, $\mathbf{20}_4$, which are respectively in the close state as shown in FIG. 1, go away from each other and consequently move from the first position to the second position shown in FIG. 4, respectively. Further, the second and third cam element portions $\mathbf{20}_2$, $\mathbf{20}_3$, which are in the close state as shown in FIG. 4, go away from each other and consequently move from the second position to the first position shown in FIG. 1, respectively.

Meanwhile, in a state in which the first cam element portion $\mathbf{20}_1$ is located at the second position located forward as shown in FIG. 4, the pin portion 32 of the first operational device $\mathbf{30}_1$ projects to its operative position which is located at a position facing the front-side facing face of the first cam element portion $\mathbf{20}_1$ and contacts the end-face cam 23 so as to move the first cam element portion $\mathbf{20}_1$ to the first position located rearward in accordance with the rotation of the camshaft 2. Likewise, in a state in which the third cam element portion $\mathbf{20}_3$ is located at the second position located forward, the pin portion 32 of the fourth operational device $\mathbf{30}_4$ projects to its operative position which is located at a position facing the front-side facing face of the third cam element portion $\mathbf{20}_3$ and contacts the end-face cam 23 so as to move the third cam element portion $\mathbf{20}_3$ to the first position located rearward in accordance with the rotation of the camshaft 2.

Moreover, in a state in which the second cam element portion $\mathbf{20}_2$ is located at the second position located rearward, the pin portion 32 of the third operational device $\mathbf{30}_3$ projects to its operative position which is located at a position facing the rear-side facing face of the second cam element portion $\mathbf{20}_2$ and contacts the end-face cam 23 so as to move the second cam element portion $\mathbf{20}_2$ to the first position located forward. Likewise, in a state in which the fourth cam element portion $\mathbf{20}_4$ is located at the second position located rearward, the pin portion 32 of the sixth operational device $\mathbf{30}_6$ projects to its operative position which is located at a position facing the rear-side facing face of the fourth cam element portion $\mathbf{20}_4$ and contacts the end-face cam 23 so as to move the fourth cam element portion $\mathbf{20}_4$ to the first position located forward.

Herein, respective projecting of the pin portions 32 of the operational devices $\mathbf{30}_1$-$\mathbf{30}_6$ are conducted at the following timings. That is, the projecting of the pin portions 32 of the first and fourth operational devices $\mathbf{30}_1$, $\mathbf{30}_4$ are conducted when the standard faces 23*a* of the front-side end-face cams 23 of the first and third cam element portions $\mathbf{20}_1$, $\mathbf{20}_3$ are located at respective directional positions of these pin portions 32. The projecting of the pin portions 32 of the third and sixth operational devices $\mathbf{30}_3$, $\mathbf{30}_6$ are conducted when the standard faces 23*a* of the rear-side end-face cams 23 of the second and fourth cam element portions $\mathbf{20}_2$, $\mathbf{20}_4$ are located at respective directional positions of these pin portions 32. The projecting of the pin portion 32 of the second operational device $\mathbf{30}_2$ is conducted when the both standard faces 23*a*, 23*a* of the two facing end-face cams 23, 23 of the first and second cam element portions $\mathbf{20}_1$, $\mathbf{20}_2$ are located at a directional position of this pin portion 32. The projecting of the pin portion 32 of the fifth operational device $\mathbf{30}_5$ is conducted when the both standard faces 23*a*, 23*a* of the two facing end-face cams 23, 23 of the third and fourth cam element portions $\mathbf{20}_1$, $\mathbf{20}_2$ are located at a directional position of this pin portion 32.

Herein, it is required that respective moving of the cam element portions $\mathbf{20}_1$-$\mathbf{20}_4$ caused by the above-described projecting of the pin portions 32 to their operative positions are conducted at the timing the cam follower C' of the rocker arm C is located at a position corresponding to the base circle a of the first cam portion $\mathbf{22}_1$ or the second cam portion $\mathbf{22}_2$, that is—when the cylinder of the engine is at another stroke than the exhaust stroke.

Accordingly, in order to meet the above-described timing conditions, the present embodiment is configured, as shown in FIGS. 7A, 7B, such that the lift starting point e of the end-face cam 23 is set at a specified phase position which is located on a rotary-advance side in the axial direction X relative to top positions of the nose portions $b_1$, $b_2$ of the first and second cam portions $\mathbf{22}_1$, $\mathbf{22}_2$, and the lift ending point f of the end-face cam 23 is set at a specified phase a position which is located on a rotary-delay side in the axial direction X relative to the lift starting point e. And, an angle from the above-described lift starting point e to the above-described lift ending point f is set to be smaller than 180 degrees. In this case, the cam element portions $\mathbf{20}_1$-$\mathbf{20}_4$ move soon after the exhaust stroke has ended in the positional relationship of the cam follower C' of the rocker arm C and the pin portions 32 of the operational devices $\mathbf{30}_1$-$\mathbf{30}_6$ shown in FIG. 2.

Herein, even if the nose portions $b_1$, $b_2$ of the first and second cam portions $\mathbf{22}_1$, $\mathbf{22}_2$ and the lift portion 23*b* of the end-face cam 23 are provided in the above-described positional relationship, there is a concern that in a case in which the pin portion 32 of the operational devices $\mathbf{30}_1$-$\mathbf{30}_6$ projects at an unexpected timing because of some operational trouble or the like, this pin portion 32 and the lift portion 23*b* may contact each other unexpectedly and improperly. Therefore, in the present embodiment, at the end-face cam 23 of the cam element portions $\mathbf{20}_1$-$\mathbf{20}_4$ is integrally provided a return slope portion 23*c* operative to compulsively retreat the pin portion 32 having projected to the operative position to its retreat position.

The actually-located position of the above-described return slope portion 23*c* changes according to conditions of the switching order of the cam portion 22 of each of the cam element portions $\mathbf{20}_1$-$\mathbf{20}_4$, the number of the operational devices 30, and so on. Despite these conditions, however, it is necessary that the return slope portion 23*c* is provided at least at the facing end portions of the cam element portions $\mathbf{20}_1$-$\mathbf{20}_4$ to be moved away from each other by the common operational devices $\mathbf{30}_1$-$\mathbf{30}_6$. In the case of the present embodiment, since the cam portion 22 of each of the cam element portions $\mathbf{20}_1$-$\mathbf{20}_4$ of the cylinders $\mathbf{1}_1$-$\mathbf{1}_4$ is switched in order of the third cylinder $\mathbf{1}_3$→the fourth cylinder $\mathbf{1}_4$→the second cylinder $\mathbf{1}_2$→the first cylinder $\mathbf{1}_1$, which is the same as the combustion order, the return slop portion 23*c* is provided at the front-and-rear both ends of the first and fourth cam element portions $\mathbf{20}_1$, $\mathbf{20}_4$, the rear end of the second cam element portion $\mathbf{20}_2$, and the front end of the third cam element portion $\mathbf{20}_3$, respectively.

As shown in FIGS. 7A, B and 9A, B, the return slope portion 23*c* has a cam face which projects further in the axial direction beyond the lift portion 23*b* and extends over a specified phase range of an end face of the end-face cam 23 which is located on the rotary-delay side (in a direction opposite to the arrow X direction) from the lift ending point f, i.e., over the range from the lift ending point (slope starting point) f to the slope ending point g, slanting outward toward the rotary-delay side. That is, the return slope portion 23*c* has the cam face, the radial-direction lift amount of which increases gradually toward the rotary-delay side. This cam face is configured such that the lift amount at the slope starting point f is slightly lower than a tip portion of the pin portion 32 being at the operative position, and the lift amount at the slope ending point g is slightly lower than the tip portion of the pin portion 32 being at the retreat position.

The above-described return slope portion 23*c* can retreat the pin portion 32 to the retreat position from the operative position when the cam face of the return slope portion 23*c* slides on the tip portion of the pin portion 32 after the move of the cam element portions $\mathbf{20}_1$-$\mathbf{20}_4$ caused by the lift portion 23*b* has ended. Herein, while the lift amount at the slope ending point g is lower than the tip portion of the pin portion 32 being at the retreat position as described above, the pin portion 32 is further pushed back to the retreat position by an inertia force of the pin portion 32 which occurs during the term from the slope starting point f to the slope ending point g and a magnetic force of the electromagnetic actuator.

Further, the return slope portion 23*c* is provided at the end-face cam 23 so as to be positioned in the projecting direction of the pin portion 32 of the operational devices $\mathbf{30}_1$-$\mathbf{30}_6$ when the adjacent cam element portions $\mathbf{20}_1$-$\mathbf{20}_4$ are away from each other. Also, the return slope portion 23*c* is configured such that when the adjacent cam element portions $\mathbf{20}_1$-$\mathbf{20}_4$ are close to each other, the facing end-face cams 23, 23, particularly the slope portion 23*c* of the end-face cam 23 and the lift portion 23*b* of the end-face cam 23 which faces the above-described end-face cam 23 do not interfere with each other.

Moreover, in the case of the present embodiment, the return slope portion 23*c* is integrally formed with the end-face cam 23, together with the lift portion 23*b*. Herein, the return slope portion 23*c* may be formed as independent parts which are separate from the cam element portions $\mathbf{20}_1$-$\mathbf{20}_4$ comprising the end-face cam, and assembled to the cam element portions $\mathbf{20}_1$-$\mathbf{20}_4$ as a unit in a later process.

(Operation of Valve Gear)

Figure 10:
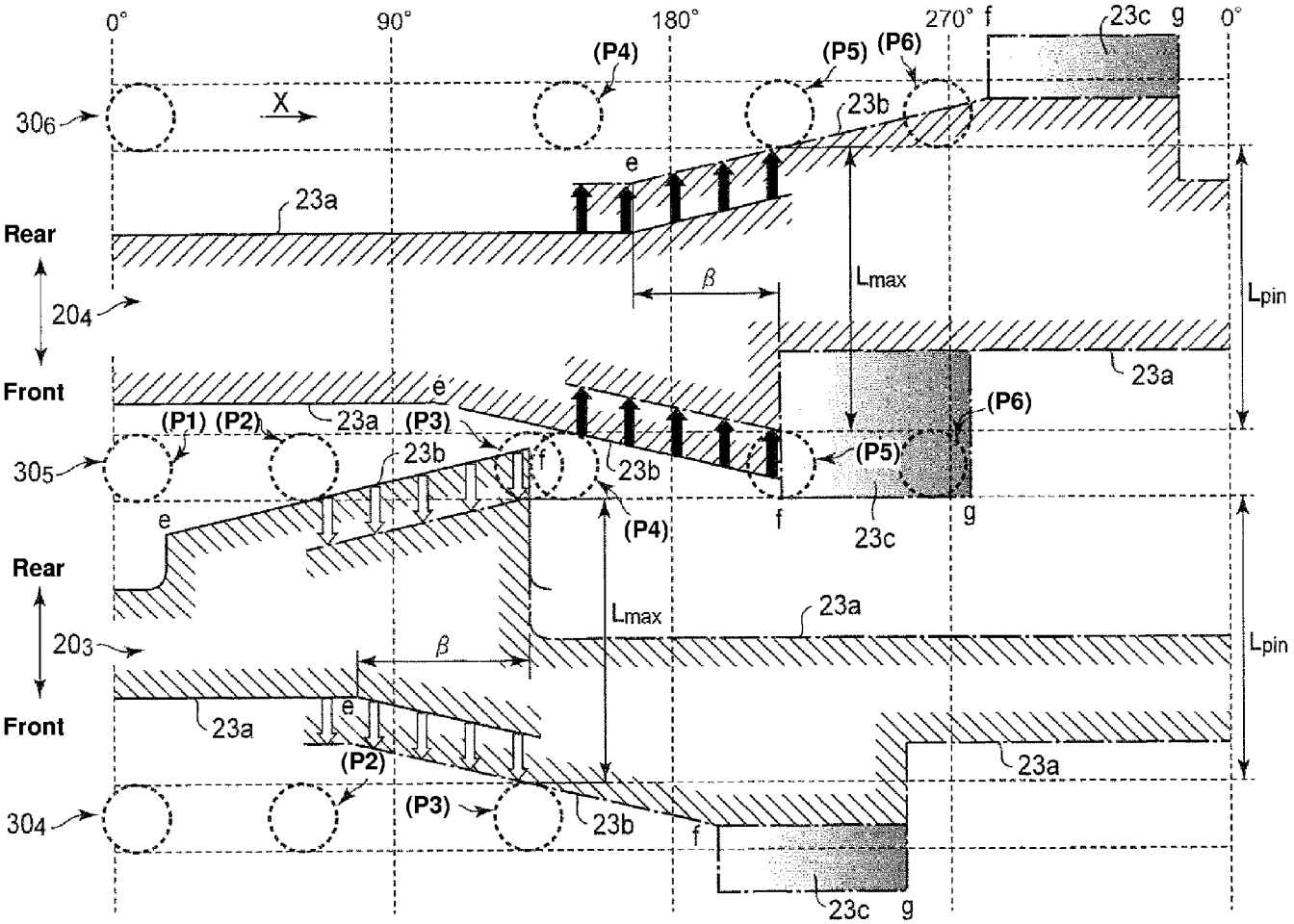
FIG. 10 is a major-part enlarged expanded diagram along a circumference of respective end-face cams, which shows positional relationships of the end-face cams and operational members when the respective cam element portions of third and fourth cylinders are moved away from each other.
Figure 11:
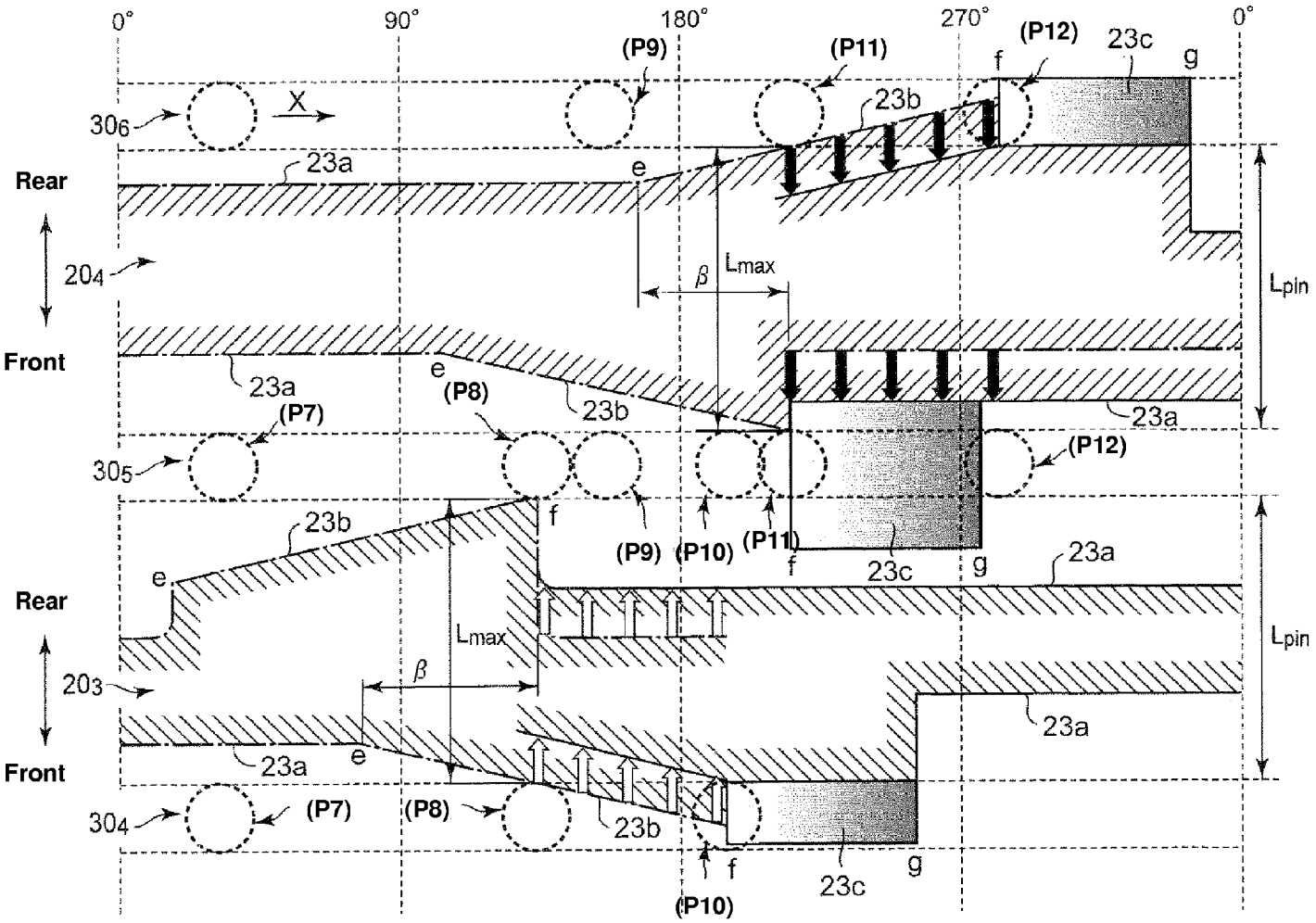
FIG. 11 is a major-part enlarged expanded diagram along the circumference of the respective end-face cams, which shows positional relationships of the end-face cams and the operational members when the respective cam element portions of third and fourth cylinders are moved so as to come close to each other.
Figure 12:
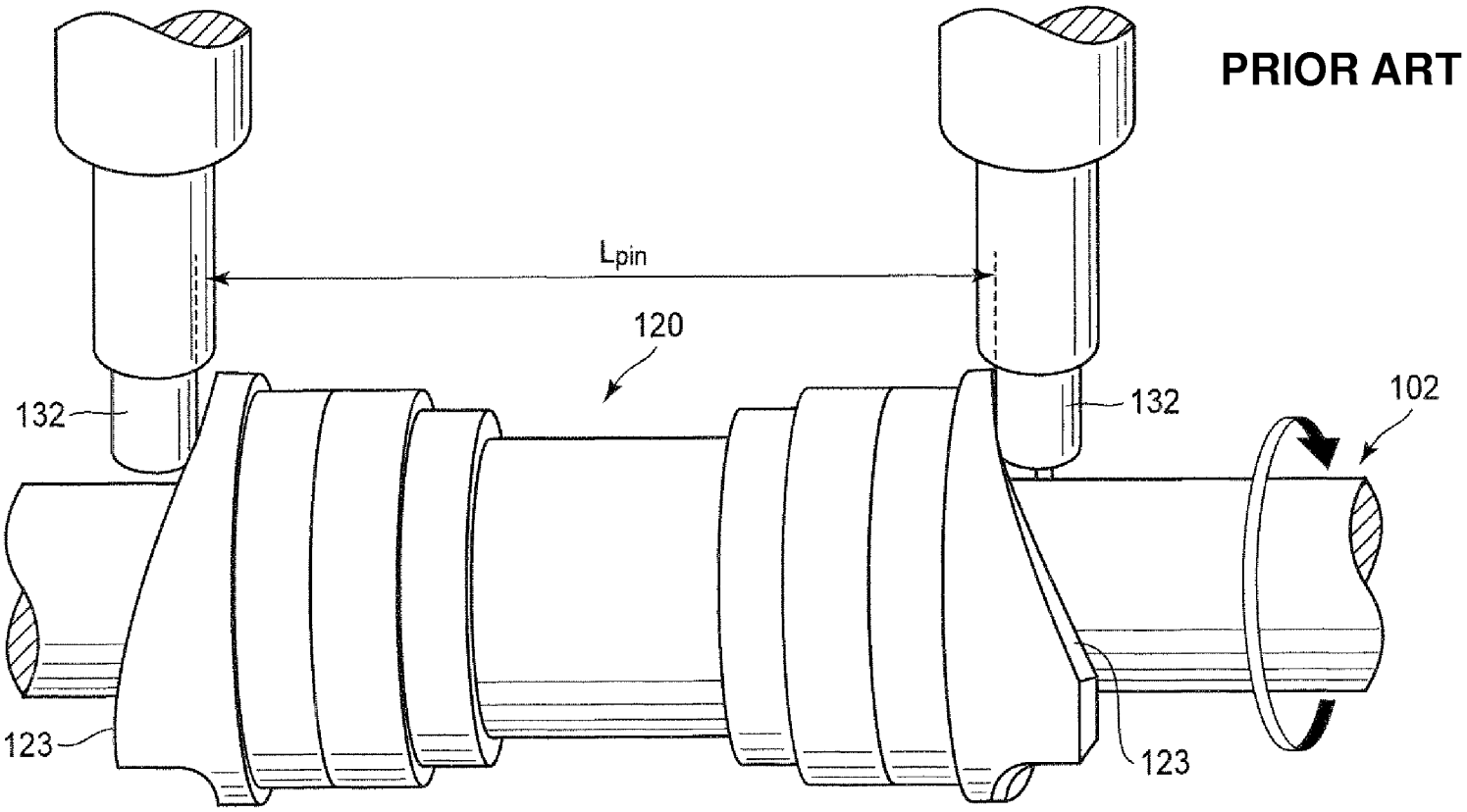
FIG. 12 is a perspective view of a conventional valve gear.

Next, the operation of the valve gear of the present embodiment will be described referring to FIGS. 10 and 11. Herein, FIGS. 10 and 11 are diagrams in which the rotations of the third and fourth cam element portions $\mathbf{20}_3$, $\mathbf{20}_4$ relative to the pin portions 32 of the operational devices $\mathbf{30}_1$-$\mathbf{30}_6$ are shown as relative moves, in the rotational direction, of the pin portions 32 to the end-face cams 23 of the both cam element portions $\mathbf{20}_3$, $\mathbf{20}_4$ (from the left to the right in the figures). And, the end-face cams 23 of the both cam element portions $\mathbf{20}_3$, $\mathbf{20}_4$ in the close state (at the first position) are shown by solid lines, and the end-face cams 23 of the both cam element portions $\mathbf{20}_3$, $\mathbf{20}_4$ in the away state (at the second position) are shown by one-dotted broken lines.

First, when the engine is in the high-speed state, for example, and the cam element portions $\mathbf{20}_1$-$\mathbf{20}_4$ are located at the first position as shown in FIG. 1, the first cam portions $\mathbf{22}_1$, $\mathbf{22}_1$ having the large lift amount of the both-end operative portions 22, 22 of the cam element portions $\mathbf{20}_1$-$\mathbf{20}_4$ are located at the positions corresponding to the cam followers C', C' of the rocker arms C, C, and the exhaust valves A . . . A of the cylinders 11-14 are opened, at the exhaust stroke, in the above-described combustion order with the relatively large valve-opening amount every two rotations of the camshaft 2.

When the situation changes from this state to a state in which the valve-opening amount of the exhaust valves A . . . A is switched so as to be relatively small, this switching is attained by activating the second and fifth operational devices $\mathbf{30}_2$, $\mathbf{30}_5$, thereby projecting the pin portions 32, 32 to the operative position from the retreat position.

That is, first, the pin portion 32 of the fifth operational device $\mathbf{30}_5$ projects to the position between the facing end-face cams 23, 23 of the third and fourth cam element portions $\mathbf{20}_3$, $\mathbf{20}_4$ being at the first position where they are in the close state, and contacts these end face cams 23, 23. In this case, as shown by reference character (P1) in FIG. 10, the above-described pin portion 32 is directed to the standard faces 23*a*, 23*a* having the zero lift amount of the facing end-face cams 23, 23 (shown by the solid line) of the third and fourth cam element portions $\mathbf{20}_3$, $\mathbf{20}_4$.

Then, first, after the exhaust stroke of the third cylinder $\mathbf{1}_3$ ends, the lift starting point e of the rear-side end-face cam 23 of the third cam element portion $\mathbf{20}_3$ reaches the position of the pin portion 32 of the fifth operational device $\mathbf{30}_5$, and then, during the term from the position shown by reference character (P2) to the position shown by reference character (P3) in FIG. 10, the pin portion 32 of the fifth operational device $\mathbf{30}_5$ slides on the lift portion 23*b* of the rear-side end-face cam 23 of the third cam element portion $\mathbf{20}_3$, thereby pushing the third cam element portion $\mathbf{20}_3$ forward (in the direction illustrated by a downward white arrow) and finally to the second position (shown by the one-dotted broken line), in accordance with the rotation of the camshaft 2.

When the third cam element portion $\mathbf{20}_3$ moves, the front-side end-face cam 23 of the third cam element portion $\mathbf{20}_3$ comes close to the pin portion 32 of the fourth operational device $\mathbf{30}_4$ being at the retreat position. Herein, the third cam element portion $\mathbf{20}_3$ is configured such that the length, in the axial direction, between the respective cam faces of the both-side end-face cams 23, 23 of the third cam element portion $\mathbf{20}_3$ which are provided at the same phase becomes the maximum value Lmax at the lift ending point f of the lift portion 23*b*. And, this the maximum value Lmax is set to be the distance Lpin, in the axial direction, between the both-side pin portions 32, 32 or smaller (in the illustration, Lmax=Lpin). Accordingly, as shown by reference character (P3) in FIG. 10, at the timing the front-side end-face cam 23 of the third cam element portion $\mathbf{20}_3$ has come the closest to the pin portion 32 of the fourth operational device $\mathbf{30}_4$, even if the pin portion 32 of the fourth operational device $\mathbf{30}_4$ projects to the operative position because of the operational malfunction or the like, the lift portion 23*b* of the front-side end-face cam 23 of the third cam element portion $\mathbf{20}_3$ may come to contact this projecting pin portion 32 of the fourth operational device $\mathbf{30}_4$, but it may not happen that the both pin portions 32, 32 of the fourth and fifth operational devices $\mathbf{30}_4$, $\mathbf{30}_5$ come to contact the respective cam faces of the both-side end-face cams 23, 23 concurrently, so that the third cam element portion $\mathbf{20}_3$ comes to get stuck between the both-side pin portions 32, 32. This is because the pin portion 32 of the fifth operational device $\mathbf{30}_5$ has already passed the lift ending point f at the above-described timing, and after the above-described timing, the length, in the axial direction, between the respective cam faces of the both-side end-face cams 23, 23 of the third cam element portion $\mathbf{20}_3$ which are provided at the same phase is smaller than the distance Lpin between the pin portions 32, 32.

Further, when the camshaft 2 rotates by 90° after the lift starting point e of the end-face cam 23 of the third cam element portion $\mathbf{20}_3$ reaches the position of the pin portion 32 of the fifth operational device $\mathbf{30}_5$, so that the exhaust stroke of the fourth cylinder $\mathbf{1}_4$ ends, the lift starting point e of the rear-side end-face cam 23 of the fourth cam element portion $\mathbf{20}_4$ reaches, and then, during the term from the position shown by reference character (P4) to the position shown by reference character (P5) in FIG. 10, the pin portion 32 of the fifth operational device $\mathbf{30}_5$ slides on the lift portion 23*b* of the rear-side end-face cam 23 of the fourth cam element portion $\mathbf{20}_4$, thereby pushing the fourth cam element portion $\mathbf{20}_4$ rearward (in the direction illustrated by an upward black arrow) and finally to the second position (shown by the one-dotted broken line), in accordance with the rotation of the camshaft 2.

When the fourth cam element portion $\mathbf{20}_4$ moves, the rear-side end-face cam 23 of the fourth cam element portion $\mathbf{20}_4$ comes close to the pin portion 32 of the six operational device $\mathbf{30}_6$ being at the retreat position. Herein, the fourth cam element portion $\mathbf{20}_4$ is configured, like the third cam element portion $\mathbf{20}_3$, such that the maximum value Lmax is the distance Lpin or smaller (in the illustration, Lmax=Lpin). Accordingly, as shown by reference character (P5) in FIG. 10, at the timing the rear-side end-face cam 23 of the fourth cam element portion $\mathbf{20}_4$ has come the closest to the pin portion 32 of the six operational device $\mathbf{30}_6$, even if the pin portion 32 of the six operational device $\mathbf{30}_6$ projects to the operative position because of the operational malfunction or the like, the lift portion 23*b* of the rear-side end-face cam 23 of the fourth cam element portion $\mathbf{20}_4$ may come to contact this projecting pin portion 32 of the six operational device $\mathbf{30}_6$, but it may not happen that the both pin portions 32, 32 of the fifth and sixth operational devices $\mathbf{30}_5$, $\mathbf{30}_6$ come to contact the cam faces of the both-side end-face cams 23, 23 concurrently, so that the fourth cam element portion $\mathbf{20}_4$ comes to get stuck between the both-side pin portions 32, 32. This is because the pin portion 32 of the fifth operational device $\mathbf{30}_5$ has already passed the lift ending point f at the above-described timing, and after the above-described timing, the length, in the axial direction, between the respective cam faces of the both-side end-face cams 23, 23 of the fourth cam element portion $\mathbf{20}_4$ which are provided at the same phase is smaller than the distance Lpin between the pin portions 32, 32.

Further, when the pin portion 32 of the fifth operational device $\mathbf{30}_5$ passes the position shown by reference character (P5) in FIG. 10, the electromagnetic actuator is deactivated. After this, as shown by reference character (P6) in FIG. 10, during the term this pin portion 32 is directed to the return slope portion 23*c*, the tip end face of the pin portion 32 slides on the cam face of the return slope portion 23*c*, thereby being pushed up and finally retuned to its retreat position compulsively, in accordance with the rotation of the camshaft 2.

The pin portion 32 is held at its retreat position by the impelling force of the return spring.

Next, the pin portion 32 of the second operational device $\mathbf{30}_2$ projects to the position between the facing end-face cams 23, 23 of the first and second cam element portions $\mathbf{20}_1$, $\mathbf{20}_2$ at the first position where they are in the close state, and contacts these end face cams 23, 23. In this case, the above-described pin portion 32 is directed to the standard faces 23*a*, 23*a* having the zero lift amount of the facing end-face cams 23, 23 of the first and second cam element portions $\mathbf{20}_1$, $\mathbf{20}_2$.

And, first, after the exhaust stroke of the second cylinder $\mathbf{1}_2$ ends, the lift starting point e of the front-side end-face cam 23 of the second cam element portion $\mathbf{20}_2$ reaches the position of the pin portion 32 of the second operational device $\mathbf{30}_2$, and then, the above-described pin portion 32 slides on the lift portion 23*b* of the front-side end-face cam 23, thereby pushing the second cam element portion $\mathbf{20}_2$ rearward and finally to the second position, in accordance with the rotation of the camshaft 2.

Further, when the camshaft 2 rotates by 90° after the lift starting point e of the end-face cam 23 of the second cam element portion $\mathbf{20}_2$ reaches the position of the pin portion 32 of the second operational device $\mathbf{30}_2$, so that the exhaust stroke of the first cylinder $\mathbf{1}_1$ ends, the lift starting point e of the front-side end-face cam 23 of the first cam element portion $\mathbf{20}_1$ which is shown by the solid line reaches the position of the pin portion 32, and then, the above-described pin portion 32 slides on the lift portion 23*b* of the front-side end-face cam 23, thereby pushing the first cam element portion $\mathbf{20}_1$ forward and finally to the second position, in accordance with the rotation of the camshaft 2.

Further, when the activation of the electromagnetic actuator of the second operational device $\mathbf{30}_2$ is stopped and the pin portion 32 is directed to the return slope portion 23*c*, the tip end face of the pin portion 32 slides on the cam face of the return slope portion 23*c*, thereby being pushed up and finally retuned to its retreat position compulsively, like the above-described fifth operational device $\mathbf{30}_5$.

The pin portion 32 is held at its retreat position by the impelling force of the return spring.

As described, all of the cam element portions $\mathbf{20}_1$-$\mathbf{20}_4$ are moved to the second position from the first position, respectively, and, as shown in FIG. 4, the second cam portions $\mathbf{22}_2$ . . . $\mathbf{22}_2$ of the both-end operative portions 22, 22 of these are located at the positions corresponding to the cam flower C', C' of the rocker arms C, C, respectively. Thereby, the exhaust valves A . . . A of the respective cylinders $\mathbf{1}_1$-$\mathbf{1}_4$ are opened with the relatively small opening amount at the exhaust stroke.

Meanwhile, the switching operation from the state in which the second cam portions $\mathbf{22}_2$ . . . $\mathbf{22}_2$ having the small lift amount of the cam element portions $\mathbf{20}_1$-$\mathbf{20}_4$ are located at the positions corresponding to the cam flower C', C' of the rocker arms C, C which is shown in FIG. 4 to the state in which the first cam portions $\mathbf{22}_1$ . . . $\mathbf{22}_1$ having the large lift amount of the cam element portions $\mathbf{20}_1$-$\mathbf{20}_4$ are located at the positions corresponding to the cam flower C', C' of the rocker arms C, C which is shown in FIG. 1, which may be caused by increase of the engine speed, for example, is conducted by making the pin portions 32 . . . 32 of the first, third, fourth and sixth operational devices $\mathbf{30}_1$, $\mathbf{30}_3$, $\mathbf{30}_4$, $\mathbf{30}_6$ project to the operative position from the retreat position, respectively, through the activation of these operational devices.

That is, first, as shown by reference character (P7) in FIG. 11, the pin portion 32 of the fourth operational device $\mathbf{30}_4$ is directed to the standard face 23*a* having the zero lift amount of the front-side end-face cam 23 of the third cam element portion $\mathbf{20}_3$, and soon projects to the position facing the end-face cam 23.

And, after the exhaust stroke of the third cylinder $\mathbf{1}_3$ ends, the lift starting point e of the front-side end-face cam 23 of the third cam element portion $\mathbf{20}_3$ reaches the projecting position of the pin portion 32 of the fourth operational device $\mathbf{30}_4$, and then, the pin portion 32 of the fourth operational device $\mathbf{30}_4$ slides on the lift portion 23*b* of the front-side end-face cam 23 during the term from a position shown by reference character (P8) to a position shown by reference character (P10) in FIG. 11, thereby pushing the third cam element portion $\mathbf{20}_3$ rearward (in the direction illustrated by an upward white arrow) and finally to the first position (illustrated by the solid line), in accordance with the rotation of the camshaft 2.

When the third cam element portion $20_3$ moves, the rear-side end-face cam 23 of the third cam element portion $20_3$ comes close to the pin portion 32 of the fifth operational device $30_5$ being at the retreat position. Herein, the third cam element portion $20_3$ is configured, as described above, such that the maximum value Lmax is the distance Lpin or smaller (in the illustration, Lmax=Lpin). Accordingly, as shown by the reference character (P8) in FIG. 11, at the timing the rear-side end-face cam 23 of the third cam element portion $20_3$ has come the closest to the pin portion 32 of the fifth operational device $30_5$, even if the pin portion 32 of the fifth operational device $30_5$ projects to the operative position because of the operational malfunction or the like, it may not happen that the both pin portions 32, 32 of the fourth and fifth operational devices $30_4$, $30_5$ come to contact the cam faces of the both-side end-face cams 23, 23 concurrently, so that the third cam element portion $20_3$ comes to get stuck between the both-side pin portions 32, 32. This is because the pin portion 32 of the fifth operational device $30_5$ has already passed the lift ending point f of the lift portion 23*b* at the above-described timing, and after the above-described timing, the length, in the axial direction, between the respective cam faces of the both-side end-face cams 23, 23 of the third cam element portion $20_3$ which are provided at the same phase is smaller than the distance Lpin between the pin portions 32, 32.

Further, when the camshaft 2 rotates by 90° after the lift starting point e of the end-face cam 23 of the third cam element portion $20_3$ reaches the position of the pin portion 32 of the fourth operational device $30_4$, so that the exhaust stroke of the third cylinder $1_3$ ends, as shown by reference character (P9) in FIG. 11, the pin portion 32 of the sixth operational device $30_6$ is directed to the standard face 23*a* having the zero lift amount of the rear-side end-face cam 23 of the fourth cam element portion $20_4$ being at the second position, and projects so as to contact this end-face cam 23.

And, after the exhaust stroke of the fourth cylinder $1_4$ ends, the lift starting point e of the rear-side end-face cam 23 of the fourth cam element portion $20_4$ reaches the projecting position of the pin portion 32 of the sixth operational device $30_6$, and then, the pin portion 32 of the sixth operational device $30_6$ slides on the lift portion 23*b* of the rear-side end-face cam 23 during the term from a position shown by reference character (P11) to a position shown by reference character (P12) in FIG. 11, thereby pushing the fourth cam element portion $20_3$ forward (in the direction illustrated by a downward black arrow) and finally to the first position (illustrated by the solid line), in accordance with the rotation of the camshaft 2.

When the fourth cam element portion $20_4$ moves, the front-side end-face cam 23 of the fourth cam element portion $20_4$ comes close to the pin portion 32 of the fifth operational device $30_5$ being at the retreat position. For the same reason described above for the case of the third cam element portion $20_3$, as shown by the reference character (P11) in FIG. 11, at the timing the front-side end-face cam 23 of the fourth cam element portion $20_4$ has come the closest to the pin portion 32 of the fifth operational device $30_5$, even if the pin portion 32 of the fifth operational device $30_5$ projects to the operative position because of the operational malfunction or the like, it may not happen that the both pin portions 32, 32 of the fifth and sixth operational devices $30_5$, $30_6$ come to contact the cam faces of the both-side end-face cams 23, 23 concurrently, so that the fourth cam element portion $20_4$ comes to get stuck between the both-side pin portions 32, 32. This is because the pin portion 32 of the fifth operational device $30_5$ has already passed the lift ending point f at the above-described timing, and after the above-described timing, the length, in the axial direction, between the respective cam faces of the both-side end-face cams 23, 23 of the fourth cam element portion $20_4$ which are provided at the same phase is smaller than the distance Lpin between the pin portions 32, 32.

Then, when the slope portion 23*c* of the end-face cam 23 of the fourth cam element portion $20_4$ does not exist below the pin portion 32 of the fifth operational device $30_5$, the pin portion 32 of the fifth operational device $30_5$ becomes movable to its operative position.

Further, at this time, the pin portion 32 of the third operational device $30_3$ projects to the facing end-face cam 23 of the second cam element portion $20_2$, and slides on the lift portion 23*b* of the rear-side end-face cam 23 of the second cam element portion $20_2$, thereby pushing the second cam element portion $20_2$ forward and finally to the first position, in accordance with the rotation of the camshaft 2.

Moreover, substantially in parallel with the above-described move (slide) of the second cam element portion $20_2$, the pin portion 32 of the first operational device $30_1$ is directed to the standard face 23*a* having the zero lift amount of the front-side end-face cam 23 of the first cam element portion $20_1$ being at the second position, and projects to the position facing this end-face cam 23.

Further, when the camshaft 2 rotates by 90° after the lift starting point e of the end-face cam 23 of the second cam element portion $20_2$ reaches the position of the pin portion 32 of the third operational device $30_3$, so that the exhaust stroke of the first cylinder $1_1$ ends, the lift starting point e of the front-side end-face cam 23 of the first cam element portion $20_1$ reaches the position of the pin portion 32 of the first operational device $30_1$, and this pin portion 32 slides on the lift portion 23*b* of the front-side end-face cam 23, thereby pushing the first cam element portion $20_1$ rearward and finally to the first position, in accordance with the rotation of the camshaft 2.

Accordingly, all of the cam element portions $20_1$-$20_4$ are moved to the first position from the second position, respectively, and, as shown in FIG. 1, the first cam portions $22_1 \ldots 22_1$ of the both-end operative portions 22, 22 of these are returned to the positions corresponding to the cam flower C', C' of the rocker arms C, C, respectively.

As described above, according to the present embodiment, the four cam element portions $20_1$-$20_4$ which are provided at the four cylinders $1_1$-$1_4$ are operated by the six operational devices $30_1$-$30_6$, and the cam portions 22 operative to control opening/closing of the exhaust valves A . . . A are switched between the first cam portions $22_1 \ldots 22_1$ having the small lift amount and the second cam portions $22_2 \ldots 22_2$ having the large lift amount, respectively.

(Features of Valve Gear)

According to the above-described present embodiment, the cam element portions $20_1$-$20_4$ are configured such that the respective lift ending points f of the both-side end-face cams 23, 23 of each of the cam element portions $20_1$-$20_4$ are provided at the respective phases which are different from each other in the rotational direction and that the maximum value Lmax of the length, in the axial direction, between the respective cam faces of the both-side end-face cams 23, 23 which are provided at the same phase is set to be the distance Lpin, in the axial direction, between the pin portions 32, 32 or smaller. That is, there is not a phase in which the length between the both-side end-face cams 23, 23 is greater than the distance Lpin between the pin portions 32, 32. Therefore, when the cam portions $22_1$, $22_2$ are switched by making one of the pin portions 32, 32 of any of the cam element portions $20_1$-$20_4$ project, thereby moving any of the cam element portions $20_1$-$20_4$ toward the arrangement side of the other pin portion 32, even if the other pin portion 32 projects erroneously because of the operational malfunction or the like, any of the cam element portions $20_1$-$20_4$ does not get stuck between the both-side pin portions 32, 32, so that it can be properly prevented that the camshaft 2 locks and stops rotating.

Further, according to the present embodiment, the cam element portions $20_1$-$20_4$ are configured such that the above-described respective phase ranges α where the respective lift portions 23*b*, 23*b* of the both-side end-face cams 23, 23 of any of the cam element portions $20_1$-$20_4$ are provided overlap each other at the respective phase ranges β, when viewed from the axial direction. Thereby, the non-lift portion 23*a* of at least one of the both-side end-face cams 23, 23 is configured such that the phase range thereof is relatively wide, compared with a case in which the respective phase ranges α do not overlap each other. Herein, the pin portion 32 is configured to project within the phase range of the non-lift portion 23*a* of the above-described at least one of the end-face cams 23, 23. Therefore, if this phase range was narrow, it might be necessary to provide any particular means for obtaining a high driving-speed of the electromagnetic actuator in order to increase the projecting speed of the pin portion 32 properly. According to the above-described embodiment, the properly wide phase range for the projection of the pin portion 32 can be ensured, preventing the locking of the camshaft 2, so that the above-described particular means may be unnecessary.

Moreover, according to the valve gear of the present embodiment applied to the engine equipped with the plural, i.e., four cylinders, the cam element portions $20_1$-$20_4$ are comprised of two pairs of cam element portions $20_1$, $20_2$ (for the both exhaust valves of the first and second cylinders) and $20_3$, $20_4$ (for the both exhaust valves of the third and fourth cylinders), and also there is provided the common operational device $30_2$ ($30_5$) including the common pin portion 32 which is configured, in the state in which the pair of cam element portions $20_1$, $20_2$ ($20_3$, $20_4$) are in the close state, to project to the position facing the both end-face cams 23, 23 of the pair of cam element portions $20_1$, $20_2$ ($20_3$, $20_4$) and contact the both lift portions 23*b*, 23*b* of the end-face cams 23, 23 so as to move the pair of cam element portions $20_1$, $20_2$ ($20_3$, $20_4$) away from each other when being at the operative position thereof.

Thereby, since the single, i.e., common pin portion 32 taking the operative position which makes the pair of cam element portions $20_1$, $20_2$ ($20_3$, $20_4$) move away from each other is provided and also the pair of cam element portions $20_1$, $20_2$ ($20_3$, $20_4$) are configured such that respective lift portions 23*b*, 23*b* of the end-face cams 23, 23 which face each other are provided at different phases, in the rotational direction, from each other and come to overlap each other in the axial direction at least partially when the pair of cam element portions $20_1$, $20_2$ ($20_3$, $20_4$) come close to each other, the valve gear can be properly compact in the axial direction of the camshaft 2, thereby improving the engine compactness.

Further, according to the present embodiment, the pair of cam element portions $20_1$, $20_2$ ($20_3$, $20_4$) are configured such that in the state in which the pair of cam element portions $20_1$, $20_2$ ($20_3$, $20_4$) are in the close state, the minimum value of the distance, in the axial direction, between respective cam faces of the facing end-face cams 23, 23 thereof which are provided at the same phase is smaller than the diameter of the pin portion 32 of the common operational device $30_2$ ($30_5$). Thereby, when the pair of cam element portions $20_1$, $20_2$ ($20_3$, $20_4$) are in the close state, even if the common pin portion 32 projects because of some operational trouble or the like, the common pin portion 32 merely hits on a surface of an outer peripheral portion of the above-described respective cam faces of the end-face cams 23, 23, not contacts the cam faces of the end-face cams 23, 23. Accordingly, it can be prevented that the cam element portions $20_1$, $20_2$ ($20_3$, $20_4$) move unexpectedly and improperly.

Additionally, according to the present embodiment, the pair of cam element portions $20_1$, $20_2$ ($20_3$, $20_4$) comprise the slope portion 23*c* including the cam face which slants outward toward the rotary-delay side from the lift ending point f of the lift portion 23*b* of the end-face cam 23 which the common pin portion 32 contacts. This slope portion 23*c* is configured to retreat the common pin portion 32 to the retreat position from the operative position when sliding on the common pin portion 32 after the axial-direction move of the cam element portions caused by the end-face cams 23 is finished. Thereby, the common pin portion 32 being at the operative position can be moved to the retreat position surely by the slope portion 23*c*. Further, since the slope portion 23*c* is configured to operate (work) after the cam element portions $20_1$, $20_2$ ($20_3$, $20_4$) have been moved by the common pin portion 32, the common pin portion 32 can be quickly retreated to the retreat position, ensuring the move of the cam element portions $20_1$, $20_2$ ($20_3$, $20_4$). Thereby, even in a case in which the cams are switched continuously, the switching operation of the cam portions $22_1$, $22_2$ can be conducted continuously in a moment.

The present invention should not be limited to the above-described embodiment, and any other modifications or improvements may be applied within the scope of the claimed invention.

For example, while the above-described invention relates to the camshaft 2 provided for the engine exhaust, the same constitutions described above can be applied to the camshaft 2 provided for the engine intake, including operations and effects.

Also, while the cam switching of the cam element portions $20_1$-$20_4$ of the engine according to the present embodiment is conducted in the combustion order: the third cylinder $1_3$→the fourth cylinder $1_4$→the second cylinder $1_2$→the first cylinder $1_1$, the other different combustion order: the second cylinder $1_2$→the first cylinder $1_1$→the third cylinder $1_3$→the fourth cylinder $1_4$ is also applicable.

The present invention is not limited to the valve gear which conducts the cam switching of the cam element portions $20_1$-$20_4$ by using the six operational devices $30_1$-$30_6$ described in the above-described embodiment. For example, the present invention is applicable to a valve gear equipped with eight operational devices $30_1$-$30_8$ in which the cam switching is conducted through respective contacting of the eight operational devices $30_1$-$30_8$ with the end-face cams 23, 23 provided at both ends of the cam element portions $20_1$-$20_4$, or further another valve gear equipped with five operational devices $30_1$-$30_5$ in which an additional common (single) operational device $30_3$ is provided between the second and third cam element portions $20_2$, $20_3$, in place of the third and fourth operational device $30_3$, $30_4$ described in the above-described embodiment.

In the above-described present embodiment, the pin portions 32 of the operational devices $30_1$-$30_6$ are configured to project toward the camshaft 2 in the same direction. Herein, the projecting direction of the pin portions 32 of the operational devices $30_1$-$30_6$ can be set differently among the operational devices $30_1$-$30_6$. For example, the pin portions 32 of part of the operational devices $30_1$-$30_6$ may be configured to project in a different direction, or the projecting direction of the pin portions 32 of the operational devices $30_1$-$30_6$ may be changed mutually.

Further, while the cam element portions $20_1$-$20_4$, of the present embodiment are configured such that the lift amount of the first cam portion $22_1$ is small and the lift amount of the second cam portion $22_2$ is large, the relation of the lift amounts between the first cam portion $22_1$ and the second cam portion $22_2$ may be set reversely. Also, it may be configured such that the cam portion $22_1$ includes the normal nose portion $b_1$, whereas the cam portion $22_2$ includes the base circle a only, without the nose portion $b_2$, so that the valve is not driven by the cam portion $22_2$. Thereby, the engine's driving with reduced cylinders in number is possible at a low-load driving condition or the like.

Also, the present invention is applicable not only to the above-described valve gear operative to switch the cams by means of the end-face cam 23, but to a valve gear operative to switch the cams by means of a so-called barrel cam in which cam grooves are provided at the outer peripheral faces of the both end portions of the cam element portions $20_1$-$20_4$. In this case, the maximum lift portions of the barrel cams provided at the both end portions are provided at respective phases which are different from each other, and the maximum value of a length, in the axial direction, between respective cam grooves which are provided at the same phase is set to be smaller than the distance, in the axial direction, between the both-side pin portions 32, 32. Thereby, the both-side pin portions 32 do not contact the cam groove concurrently, so that the above-described valve gear using the barrel cam can also prevent that the camshaft 2 locks and stop rotating.

Additionally, the present invention is applicable not only to the four-cylinder four-valve DOHC engine described in the present embodiment, but to any other type of engine which has a different number of cylinders or a different valve-driving type, including an inline six-cylinder engine, a V-shaped multi-cylinder engine, a four-cylinder 2-vale DOHC engine, a single-cylinder SOHC engine, and a multi-cylinder SOHC engine.

What is claimed is:

1. A valve gear of an engine, comprising:

a camshaft having a shaft portion and a cam element portion, the cam element portion being coupled to the shaft portion so as to rotate integrally with the shaft portion and to move in an axial direction of the shaft portion; and an operational device operative to move the cam element portion of said camshaft in the axial direction relative to the shaft portion, wherein said cam element portion comprises two cam portions for each valve which have a common base circle and different-shaped nose portions, which are provided adjacently to each other in the axial direction, the two cam portions operative to control opening/closing of the valve being configured to be switchable when moved in the axial direction on the shaft portion, said cam element portion further comprises a pair of end-face cams which are provided at both-end faces, in the axial direction, of the cam element portion, each of the end-face cams having a lift portion which is configured to project in the axial direction such that the amount of projection of the lift portion increases gradually along a rotational direction of the cam element portion in a specified phase range, said operational device comprises a first operational member which is arranged on one side of said cam element portion and a second operational member which is arranged on the other side of the cam element portion, the first operational member being configured to be driven by an actuator so as to take an operative position in which the first operational member projects to a position facing one of the end-face cams which is located on an arrangement side of the first operational member and contacts the lift portion of said one of the end-face cams so as to move the cam element portion along the shaft portion toward said other side of the cam element portion and a retreat position in which the first operational member retreats from said position facing the one of the end-face cams, the second operational member being configured to be driven by an actuator so as to take an operative position in which the second operational member projects to a position facing the other of the end-face cams which is located on an arrangement side of the second operational member and contacts the lift portion of said other of the end-face cams so as to move the cam element portion along the shaft portion toward said one side of the cam element portion and a retreat position in which the second operational member retreats from said position facing the other of the end-face cams, and said cam element portion is configured such that respective maximum lift portions of the pair of end-face cams are provided at respective phases which are different from each other in the rotational direction and that the maximum value of a length, in the axial direction, between respective cam faces of the pair of end-face cams which are provided at the same phase is less than or equal to a distance in the axial direction between a contact of the first operational member with the one of the end-face cams and a contact of the second operational member with the other of the end-face cams.

2. The valve gear of an engine of claim 1, wherein the respective lift portions of the pair of end-face cams of said cam element portion are configured such that said specified phase ranges thereof overlap each other in the rotational direction.

3. The valve gear of an engine of claim 1, wherein the engine is equipped with plural cylinders which are arranged in the axial direction of said shaft portion of the camshaft, said cam element portion is configured as plural cam element portions which are provided for the engine as a whole and at least one of which is provided for each cylinder, at least part of said plural cam element portions includes a pair of cam element portions which are provided for valves of two adjacent cylinders, said pair of cam element portions being configured such that respective lift portions of the end-face cams thereof which face each other are provided at different phases, in the rotational direction, from each other and come to overlap each other in the axial direction at least partially when the pair of cam element portions come close to each other, and said operational device further includes a common operational member of a common operational device, which is configured, in a state in which said pair of cam element portions are in a close state, to project to a position facing the both end-face cams of the pair of cam element portions and contact the both lift portions of the end-face cams so as to move the pair of cam element portions away from each other when being at the operative position thereof.

4. The valve gear of an engine of claim 2, wherein the engine is equipped with plural cylinders which are arranged in the axial direction of said shaft portion of the camshaft, said cam element portion is configured as plural cam element portions which are provided for the engine as a whole and at least one of which is provided for each cylinder, at least part of said plural cam element portions includes a pair of cam element portions which are provided for valves of two adjacent cylinders, said pair of cam element portions being configured such that respective lift portions of the end-face cams thereof which face each other are provided at different phases, in the rotational direction, from each other and come to overlap each other in the axial direction at least partially when the pair of cam element portions come close to each other, and said operational device further includes a common operational member of a common operational device, which is configured, in a state in which said pair of cam element portions are in a close state, to project to a position facing the both end-face cams of the pair of cam element portions and contact the both lift portions of the end-face cams so as to move the pair of cam element portions away from each other when being at the operative position thereof.

5. The valve gear of an engine of claim 3, wherein said common operational member is configured substantially in a cylindrical shape, and said pair of cam element portions are configured such that in the state in which the pair of cam element portions are in the close state, the minimum value of a distance, in the axial direction, between respective cam faces of the facing end-face cams thereof which are provided at the same phase is smaller than the diameter of the common operational member.

6. The valve gear of an engine of claim 4, wherein said common operational member is configured substantially in a cylindrical shape, and said pair of cam element portions are configured such that in the state in which the pair of cam element portions are in the close state, the minimum value of a distance, in the axial direction, between respective cam faces of the facing end-face cams thereof which are provided at the same phase is smaller than the diameter of the common operational member.

7. The valve gear of an engine of claim 3, wherein said pair of cam element portions further comprise, respectively, a slope portion which slants outward toward the rotary-delay side from the maximum-lift portion of the end-face cam which the said common operational member contacts, the slope portion being configured to retreat the common operational member to the retreat position from the operative position when sliding on the common operational member after the axial-direction move of the cam element portions caused by the end-face cams is finished.

8. The valve gear of an engine of claim 4, wherein said pair of cam element portions further comprise, respectively, a slope portion which slants outward toward the rotary-delay side from the maximum-lift portion of the end-face cam which the said common operational member contacts, the slope portion being configured to retreat the common operational member to the retreat position from the operative position when sliding on the common operational member after the axial-direction move of the cam element portions caused by the end-face cams is finished.

9. The valve gear of an engine of claim 5, wherein said pair of cam element portions further comprise, respectively, a slope portion which slants outward toward the rotary-delay side from the maximum-lift portion of the end-face cam which the said common operational member contacts, the slope portion being configured to retreat the common operational member to the retreat position from the operative position when sliding on the common operational member after the axial-direction move of the cam element portions caused by the end-face cams is finished.

10. The valve gear of an engine of claim 6, wherein said pair of cam element portions further comprise, respectively, a slope portion which slants outward toward the rotary-delay side from the maximum-lift portion of the end-face cam which the said common operational member contacts, the slope portion being configured to retreat the common operational member to the retreat position from the operative position when sliding on the common operational member after the axial-direction move of the cam element portions caused by the end-face cams is finished.

11. The valve gear of an engine of claim 1, wherein the respective lift portions of the pair of end-face cams of said cam element portion are configured such that said specified phase ranges thereof overlap each other in the rotational direction.

12. The valve gear of an engine of claim 1, wherein the engine is equipped with plural cylinders which are arranged in the axial direction of said shaft portion of the camshaft, said cam element portion is configured as plural cam element portions which are provided for the engine as a whole and at least one of which is provided for each cylinder, at least part of said plural cam element portions includes a pair of cam element portions which are provided for valves of two adjacent cylinders, said pair of cam element portions being configured such that respective lift portions of the end-face cams thereof which face each other are provided at different phases, in the rotational direction, from each other and come to overlap each other in the axial direction at least partially when the pair of cam element portions come close to each other, and said operational device further includes a common operational member of a common operational device, which is configured, in a state in which said pair of cam element portions are in a close state, to project to a position facing the both end-face cams of the pair of cam element portions and contact the both lift portions of the end-face cams so as to move the pair of cam element portions away from each other when being at the operative position thereof.

13. The valve gear of an engine of claim 2, wherein the engine is equipped with plural cylinders which are arranged in the axial direction of said shaft portion of the camshaft, said cam element portion is configured as plural cam element portions which are provided for the engine as a whole and at least one of which is provided for each cylinder, at least part of said plural cam element portions includes a pair of cam element portions which are provided for valves of two adjacent cylinders, said pair of cam element portions being configured such that respective lift portions of the end-face cams thereof which face each other are provided at different phases, in the rotational direction, from each other and come to overlap each other in the axial direction at least partially when the pair of cam element portions come close to each other, and said operational device further includes a common operational member of a common operational device, which is configured, in a state in which said pair of cam element portions are in a close state, to project to a position facing the both end-face cams of the pair of cam element portions and contact the both lift portions of the end-face cams so as to move the pair of cam element portions away from each other when being at the operative position thereof.

14. The valve gear of an engine of claim 3, wherein said common operational member is configured substantially in a cylindrical shape, and said pair of cam element portions are configured such that in the state in which the pair of cam element portions are in the close state, the minimum value of a distance, in the axial direction, between respective cam faces of the facing end-face cams thereof which are provided at the same phase is smaller than the diameter of the common operational member.

15. The valve gear of an engine of claim 4, wherein said common operational member is configured substantially in a cylindrical shape, and said pair of cam element portions are configured such that in the state in which the pair of cam element portions are in the close state, the minimum value of a distance, in the axial direction, between respective cam faces of the facing end-face cams thereof which are provided at the same phase is smaller than the diameter of the common operational member.

16. The valve gear of an engine of claim 3, wherein said pair of cam element portions further comprise, respectively, a slope portion which slants outward toward the rotary-delay side from the maximum-lift portion of the end-face cam which the said common operational member contacts, the slope portion being configured to retreat the common operational member to the retreat position from the operative position when sliding on the common operational member after the axial-direction move of the cam element portions caused by the end-face cams is finished.

17. The valve gear of an engine of claim 4, wherein said pair of cam element portions further comprise, respectively, a slope portion which slants outward toward the rotary-delay side from the maximum-lift portion of the end-face cam which the said common operational member contacts, the slope portion being configured to retreat the common operational member to the retreat position from the operative position when sliding on the common operational member after the axial-direction move of the cam element portions caused by the end-face cams is finished.

18. The valve gear of an engine of claim 5, wherein said pair of cam element portions further comprise, respectively, a slope portion which slants outward toward the rotary-delay side from the maximum-lift portion of the end-face cam which the said common operational member contacts, the slope portion being configured to retreat the common operational member to the retreat position from the operative position when sliding on the common operational member after the axial-direction move of the cam element portions caused by the end-face cams is finished.

19. The valve gear of an engine of claim 6, wherein said pair of cam element portions further comprise, respectively, a slope portion which slants outward toward the rotary-delay side from the maximum-lift portion of the end-face cam which the said common operational member contacts, the slope portion being configured to retreat the common operational member to the retreat position from the operative position when sliding on the common operational member after the axial-direction move of the cam element portions caused by the end-face cams is finished.

20. A valve gear of an engine, comprising:

a camshaft having a shaft portion and a cam element portion, the cam element portion being coupled to the shaft portion so as to rotate integrally with the shaft portion and to move in an axial direction of the shaft portion; and an operational device operative to move the cam element portion of said camshaft in the axial direction relative to the shaft portion, wherein said cam element portion comprises two cam portions for each valve which have a common base circle and different-shaped nose portions, which are provided adjacently to each other in the axial direction, each of the two adjacent nose portions extending from the base circle in a different circumferential location, the two cam portions operative to control opening/closing of the valve being configured to be switchable when moved in the axial direction on the shaft portion, said cam element portion further comprises a pair of end-face cams which are provided at both-end faces, in the axial direction, of the cam element portion, each of the end-face cams having a lift portion which is configured to project in the axial direction such that the amount of projection of the lift portion increases gradually along a rotational direction of the cam element portion in a specified phase range, said operational device comprises a first operational member which is arranged on one side of said cam element portion and a second operational member which is arranged on the other side of the cam element portion, the first operational member being configured to be driven by an actuator so as to take an operative position in which the first operational member projects to a position facing one of the end-face cams which is located on an arrangement side of the first operational member and contacts the lift portion of said one of the end-face cams so as to move the cam element portion along the shaft portion toward said other side of the cam element portion and a retreat position in which the first operational member retreats from said position facing the one of the end-face cams, the second operational member being configured to be driven by an actuator so as to take an operative position in which the second operational member projects to a position facing the other of the end-face cams which is located on an arrangement side of the second operational member and contacts the lift portion of said other of the end-face cams so as to move the cam element portion along the shaft portion toward said one side of the cam element portion and a retreat position in which the second operational member retreats from said position facing the other of the end-face cams, and said cam element portion is configured such that respective maximum lift portions of the pair of end-face cams are provided at respective phases which are different from each other in the rotational direction and that the maximum value of a length, in the axial direction, between respective cam faces of the pair of end-face cams which are provided at the same phase is set to be an arrangement distance, in the axial direction, between said first operational member and said second operational member or smaller.

* * * * *